US012188738B2

(12) United States Patent
Fleiner et al.

(10) Patent No.: US 12,188,738 B2
(45) Date of Patent: Jan. 7, 2025

(54) GAS BLOCK FOR AUTOMATIC FIREARMS

(71) Applicant: Heckler & Koch GmbH, Oberndorf/Neckar (DE)

(72) Inventors: Uwe Fleiner, BL-Dürrwangen (DE); Stefan Doll, Oberndorf (DE); Johannes Kopf, Dunningen (DE)

(73) Assignee: HECKLER &KOCH GMBH, Oberndorf/Neckar (DE)

( * ) Notice: Subject to any disclaimer, the term of this patent is extended or adjusted under 35 U.S.C. 154(b) by 0 days.

(21) Appl. No.: 17/966,522

(22) Filed: Oct. 14, 2022

(65) Prior Publication Data

US 2023/0122319 A1 Apr. 20, 2023

(30) Foreign Application Priority Data

Oct. 15, 2021 (DE) ..... 10 2021 005 162.9

(51) Int. Cl.
*F41A 5/28* (2006.01)

(52) U.S. Cl.
CPC ..... *F41A 5/28* (2013.01)

(58) Field of Classification Search
CPC ..... F41A 5/18; F41A 5/26; F41A 5/28; F41A 5/30
See application file for complete search history.

(56) References Cited

U.S. PATENT DOCUMENTS 1,020,596 A * 3/1912 Brauning ..... F41A 5/18 89/145
2,144,241 A * 1/1939 Eiane ..... F41A 19/30 89/154
2,149,512 A * 3/1939 Eiane ..... F41A 5/26 89/193
2,462,119 A * 2/1949 Moore ..... F41A 5/28 89/193

(Continued)

FOREIGN PATENT DOCUMENTS

BE 332360 A 2/1926
CA 2659573 A1 2/2008

(Continued)

OTHER PUBLICATIONS

German Patent Office, "Office Action", issued in connection with German Patent Application No. 10 2021 005 162.9, issued on Jun. 20, 2022, with English Translation, 20 pages.

(Continued)

*Primary Examiner* — Jonathan C Weber
(74) *Attorney, Agent, or Firm* — Hanley, Flight & Zimmerman, LLC

(57) ABSTRACT

Example methods, systems, and apparatus are described herein. An example gas block is described for an automatic firearm, which has a gas cylinder that can be connected in a fluid-tight manner to a hole in the gun barrel via a gas channel, characterized by a control element that can be switched between at least two positions and is designed to open the gas channel in the first position, in which the (Continued)

fluid-tight connection is obtained, and to close the gas channel in the second position, in which the fluid-tight connection is interrupted. The disclosure also relates to a control element, a gun barrel equipped with the gas block, and an automatic firearm equipped with the gas block.

22 Claims, 18 Drawing Sheets

(56) References Cited

U.S. PATENT DOCUMENTS

| | | | | |
|---|---|---|---|---|
| 2,748,662 | A * | 6/1956 | Simpson | F41A 5/28 251/207 |
| 2,791,944 | A | 5/1957 | Harvey | |
| 3,156,992 | A * | 11/1964 | Beretta | F41C 27/06 42/105 |
| 4,635,530 | A | 1/1987 | Weldle | |
| 6,260,821 | B1 * | 7/2001 | Perry | F41B 11/724 251/309 |
| 8,528,458 | B2 * | 9/2013 | Windauer | F41A 5/26 89/193 |
| 9,459,061 | B2 * | 10/2016 | Cassels | F41A 5/28 |
| 9,857,129 | B1 | 1/2018 | Kelly et al. | |
| 10,488,130 | B2 * | 11/2019 | Kingsbury | F41A 5/26 |
| 10,830,546 | B2 | 11/2020 | Fleiner et al. | |
| 10,935,335 | B2 * | 3/2021 | Miller | F41A 5/28 |
| 11,287,201 | B1 * | 3/2022 | Underwood | F41A 5/26 |
| 2006/0065112 | A1 * | 3/2006 | Kuczynko | F41A 5/28 89/193 |
| 2009/0229454 | A1 * | 9/2009 | Fluhr | F41A 5/26 89/193 |
| 2010/0186582 | A1 * | 7/2010 | Juarez | F41A 5/28 89/191.01 |
| 2013/0025445 | A1 * | 1/2013 | Windauer | F41A 5/28 89/193 |
| 2013/0098235 | A1 * | 4/2013 | Reinken | F41A 5/28 89/193 |
| 2014/0224114 | A1 * | 8/2014 | Faxon | F41A 5/28 89/193 |
| 2015/0241149 | A1 | 8/2015 | Mcmillen, IV | |
| 2016/0003565 | A1 * | 1/2016 | Kingsbury | F41A 5/26 89/194 |
| 2016/0209138 | A1 | 7/2016 | DeSomma | |
| 2017/0115081 | A1 | 4/2017 | Maranli | |
| 2017/0307315 | A1 * | 10/2017 | McGLOIN | F41A 5/28 |
| 2019/0170460 | A1 * | 6/2019 | Kingsbury | F41A 5/26 |
| 2020/0025477 | A1 * | 1/2020 | Williams | F41A 3/66 |
| 2020/0263943 | A1 * | 8/2020 | Kingsbury | F41A 21/30 |
| 2021/0055067 | A1 * | 2/2021 | Nguyen | F41A 5/28 |
| 2022/0221238 | A1 * | 7/2022 | Salinas | F41A 5/28 |

FOREIGN PATENT DOCUMENTS

| | | | | |
|---|---|---|---|---|
| DE | 597 634 | | 5/1934 | |
| DE | 22 49 545 | | 4/1974 | |
| DE | 32 44 315 | | 5/1984 | |
| DE | 102006056130 | A1 * | 2/2008 | F41A 5/26 |
| DE | 10 2017 002 165 | | 9/2018 | |
| DE | 102017002242 | A1 | 9/2018 | |
| EP | 3800425 | A1 | 4/2021 | |
| GB | 252429 | A | 5/1926 | |
| WO | WO-2008014984 | A1 * | 2/2008 | F41A 5/26 |
| WO | WO-2010123604 | A2 * | 10/2010 | F41A 21/28 |

OTHER PUBLICATIONS

European Patent Office, "Extended European Search Report," in connection with European Patent Application No. 22201618.0, issued Feb. 28, 2023, 12 pages, with English translation.

Canadian Intellectual Property Office, "Requisition by Examiner," issued in connection with Canadian Patent Application No. 3,179,149, dated Sep. 13, 2024, 5 pages.

* cited by examiner

GAS BLOCK FOR AUTOMATIC FIREARMS

RELATED APPLICATION

This patent claims the benefit of German Patent Application No. 10 2021 005 162.9, which was filed on Oct. 15, 2021. German Patent Application No. 10 2021 005 162.9 is hereby incorporated herein by reference in its entirety. Priority to German Patent Application No. 10 2021 005 162.9, is hereby claimed.

FIELD OF THE DISCLOSURE

This disclosure relates to a gas block according to the preamble of claim 1 for an automatic firearm. The disclosure also relates to a control element for such a gas block. The disclosure further relates to a gun barrel with such a gas block. The disclosure also relates to an automatic firearm equipped with a gas block of this type.

BACKGROUND

There are various known forms of gas blocks for automatic firearms and gun barrels equipped therewith, and various forms of automatic firearms (e.g. assault weapons, machine guns and sniper rifles).

BRIEF DESCRIPTION OF THE DRAWINGS

Disclosed examples are explained in greater detail below in reference to the attached drawings. Other examples are possible.

Figure 1:
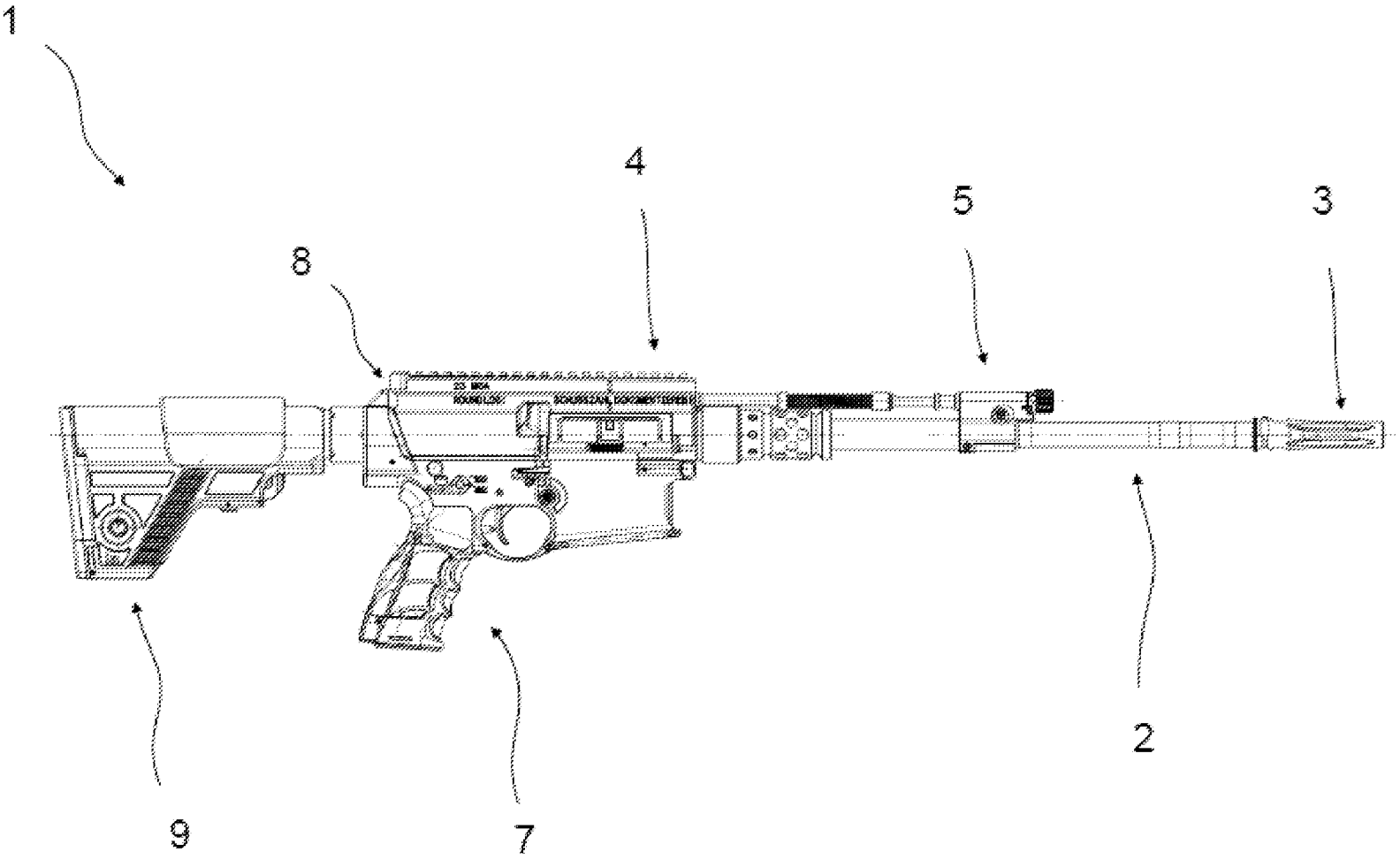
FIG. 1 shows an example side view of firearm.

The structure and functioning of the gas block for an automatic firearm, or a gun barrel and an automatic firearm that has such a gas block shall be explained below in reference to the drawings. The drawings show disclosed examples.

In these documents, position terms such as "up," "down," "front," "back," etc. relate to a firearm in which the bore axis is horizontal and shots are fired forwards, away from the shooter.

DETAILED DESCRIPTION

Gas blocks are normally placed on a gun barrel in the front third thereof. There is a gas channel inside the gas block that is connected in a fluid-tight manner to a hole in the barrel such that propellant gasses can be diverted through it from the barrel when a shot is fired in order to operate a gas-operated reloading mechanism. The gun barrel is located inside a receiver in a so-called barrel receiver and fixed in place therein. There is also a breechblock assembly that moves longitudinally in the receiver when a shot is fired, for removing a cartridge shell that has been fired, and for reloading.

The sequence of firing a shot and automatic reloading can be described in a simplified manner as follows: the breechblock, in particular the bolt head, guides a cartridge out of a cartridge supply magazine in the known manner into a chamber in the barrel in order to fire a shot. When a trigger mechanism is operated, a firing pin strikes the back of the cartridge and ignites a propellant, thus firing a projectile from the cartridge through the barrel. Once the projectile passes the hole in the barrel, the gas released during the firing process is diverted into the gas block.

The diverted propellant gas is used to return the breechblock in the known manner. The propellant gasses drive the breechblock backward at a high speed toward the stock via the gas block and a gas rod coupled thereto. There is a block at the bolt head, which grips the rim at the rear of the cartridge casing and pulls it out of the magazine as the breechblock moves backward. An ejector ejects the casing from the receiver through a cartridge ejection window in the known manner. As the breechblock moves forward, a new cartridge is then guided into the chamber, and the cycle is repeated. When the breechblock is at its foremost position, the breechblock closes off the rear end of the barrel, such that when the charge is ignited, none of the exhaust gas can escape from the barrel toward the back.

An exemplary gas block for an assault rifle, HK 433, is shown in DE 10 2017 002 165 A1 by the applicant, which is incorporated herein by reference in its entirety. The gas block has a mount with which the gas block is attached to a gun barrel, a gas cylinder that can be connected to via a gas channel to a hole in the barrel, and a gas piston that can move longitudinally in the gas cylinder in order to drive a gas operated reloading mechanism. An end element can be releasably coupled to the end of the gas cylinder facing the stock which has a passage for the piston. A barrel equipped with such a gas block and an automatic rifle with such a barrel are also disclosed therein.

Figure 6:
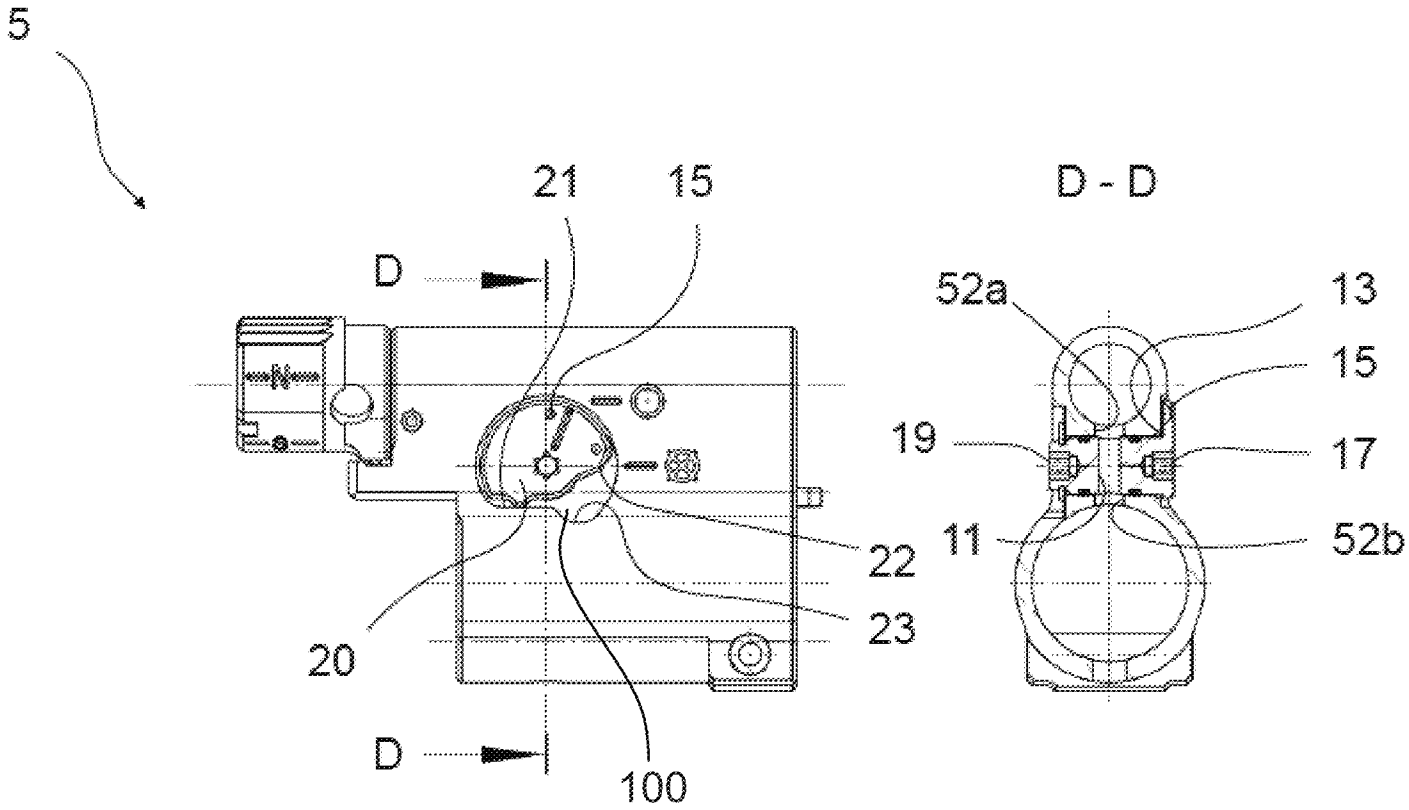
FIG. 6 shows another example cross section of the gas block in FIG. 5 and from the front.
Figure 7:
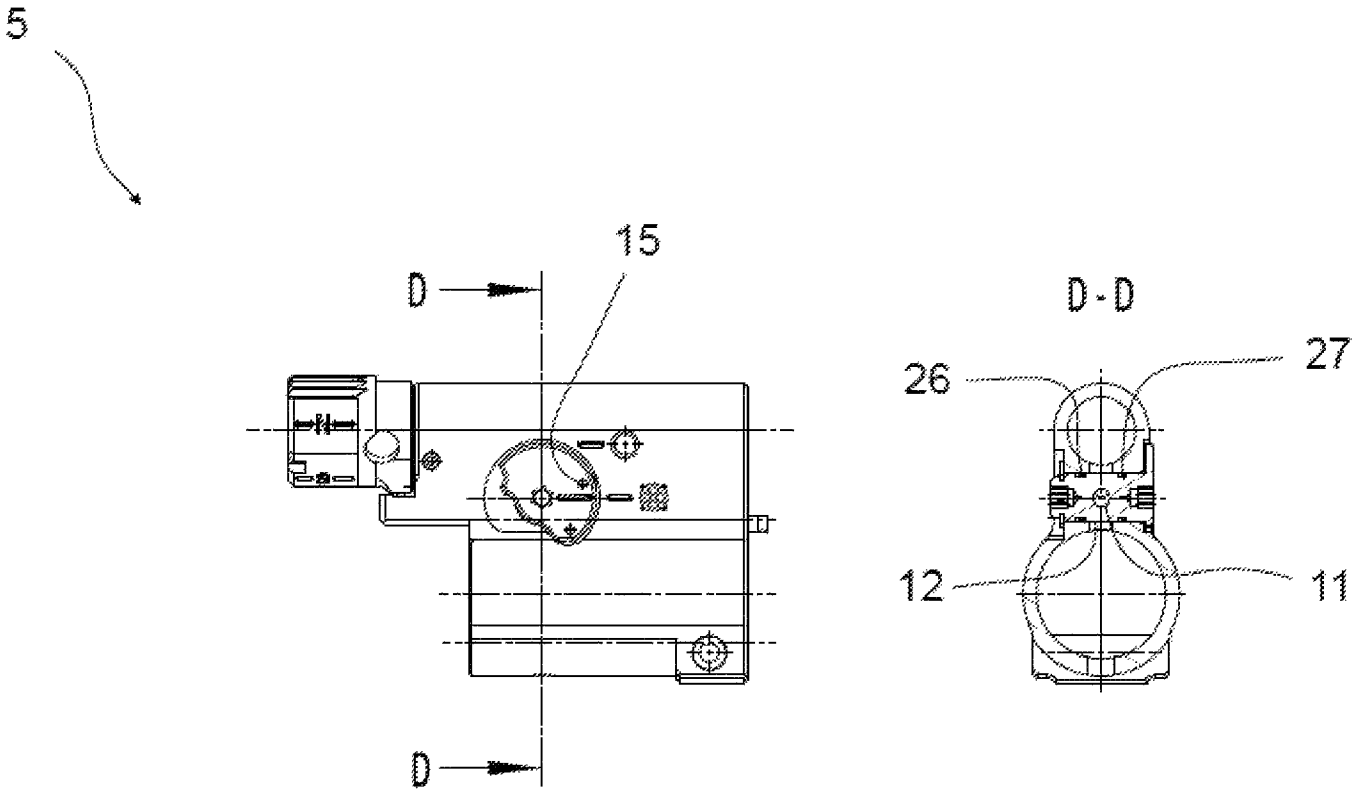
FIG. 7 shows the example gas block in FIGS. 5 and 6 when the control element is closed.

A system for controlling the gas flow to a module containing moving parts in an automatic rifle is shown in US 2015/0241149 A1. The gun function of the drive in this system is coordinated via a threaded bolt on a component in the breechblock carrier, as can be seen in FIG. 6 and FIG. 7 in US 2015/0241149 A1. As a result of the seal obtained with the threaded bolt, the gas flow cannot be entirely shut off in this system. Among other things, this can result in increased contaminant accumulation in the chamber. Furthermore, this system can only be operated to a limited extent. There is no repeater function with this system because there is always a movement of the breechblock when a shot is fired.

A firearm is shown in US 2016/0209138 A1 in which the gas pressure in the operating system can be adjusted. The gas flow can be regulated with a threaded setscrew such that linear displacement takes place. The weapon function and the shut-off function can therefore be controlled with the same control element. The user therefore has the possibility of altering the fundamental manner in which the weapon functions. The numerous possible adjustments can result in errors occurring. Furthermore, switching from one function to another is time-consuming.

As described below, the examples disclosed herein create an alternative gas block and a gun barrel equipped therewith, as well as an automatic firearm that has such a gas block. A gas block is therefore to be provided that can be quickly, reliably and entirely closed and opened without having to alter the fundamental functioning of the weapon. Furthermore, examples disclosed herein describe a gas block that still functions safely when dirty, and is also compact.

A first example disclosed herein describes a gas block for an automatic firearm. The gas block contains a gas cylinder that can be connected in a fluid-tight manner to a hole in a gun barrel via a gas channel.

Unlike previous solutions, the gas block contains a control element that can assume two positions and is designed to open the gas channel in the first position to provide the fluid-tight connection, and to close the gas channel in the second position in order to interrupt the fluid-tight connection.

In disclosed examples, the control element does not regulate the gas flow in a variable or linear manner, as is the case in previous solutions, but instead in a stepped manner. This stepped regulation or adjustment allows for a quick and precise setting of the control element such that the gas block can be quickly and reliably opened and closed.

While propellant gas can be diverted in the at least first position, such that the breechblock assembly is moved backward in the known manner, in the at least second position, none, or only a small amount, of the propellant gas is diverted. Ammunition is not supplied automatically in this position, and can only be loaded by a manual operation of the loading lever.

In other words, examples disclosed herein describe a gas block that can be "shut off" It is therefore possible to switch between automatic operation and single-shot operation. The automatic operation can be understood to be either a semi-automatic or full automatic operating mode of the weapon. Single-shot operation or the repeater function can be understood to mean that the weapon functions in a manner in which the ammunition is loaded into the chamber from a magazine using a manual loading mechanism. In this case, the weapon substantially functions like a repeating rifle.

The repeater function has proven to be advantageous when using rifle grenades and/or subsonic ammunition. Subsonic ammunition exhibits a maximum projectile exit speed of approximately 330 meters/second. In order to obtain the greatest possible projectile power despite this limited projectile speed, subsonic ammunition projectiles are normally heavier than standard shells. Because a heavy projectile exhibits a greater resistance to the gas pressure of the propellant charge due to its greater inertia, powders that burn more slowly are usually used in order to keep the gas pressure inside the weapon within the acceptable limits. It is also possible for errors to occur when operating the weapon with subsonic ammunition, which can substantially be traced back to the weaker charge associated with this specific ammunition.

Use of a gas block implemented according to the teachings of this disclosure can prevent a malfunctioning of the weapon, including weapons fired using subsonic ammunition. Advantageously, example gas blocks described herein also aide in the prevention of noise emissions that would occur during a repeater process. Such noise prevention may be desirable, for example, during tactical deployment.

It is possible to have more than two switching positions (e.g. three or four, or more switching positions) in order to obtain a gas block that enables a stepped decrease or increase in diverting the propellant gasses. As a result, different gas pressures can be obtained for different operating modes or different ammunitions. Therefore, example gas blocks described herein can quickly and entirely open and close, while still allowing for one or more intermediate switching positions, thus enabling a predetermined gas flow rate.

Example gas blocks described herein may also include a control element that can only assume exactly two switching positions, such that the gas channel is either entirely opened or entirely closed. A control element that can only be opened or closed is also referred to as a binary valve. This results in a gas block with a structurally simple shut-off device, with which the gas block can be quickly, reliably and entirely opened and closed, without having to alter the fundamental functioning of the weapon, for example.

In some examples, the control element in the form of a nozzle body with at least one bore and at least one outer wall, and the nozzle body is designed to be moved such that when it is in the first position, the bore connects the gas cylinder to the hole in the barrel in a fluid-tight manner, and when in the second position, the outer wall of the nozzle shuts off the gas channel.

In some examples. the bore is in the form of a nozzle in which the cross section exhibits a uniform size over its entire length. In such examples, the size of the cross section of the bore, or nozzle, may be the same or less than the size of the cross section of the gas channel.

In some examples, the control element is in the gas block such that it is transverse to the direction in which the weapon is fired. With this placement, the control element can be swiveled about its longitudinal axis between the at least two positions, or it can be placed in the gas block such that it can be moved longitudinally along its longitudinal axis. In such examples, the control element can be swiveled about its longitudinal axis (i.e., rotated about its own axis).

In a structurally simple disclosed example, there is at least one hole in the gas block through which the control element is at least partially inserted such that it is supported in the gas block. In such examples, the at least one hole may pass entirely through the gas block, transverse to the direction in which the weapon is fired.

The axes of gas channel in the gas block and the at least one hole for the control element may intersect. In some examples, this intersection forms an angle of 90°. In some examples, the gas channel in the gas block is perpendicular, passing through the hole in the gas block for the control element that is transverse to the direction in which the weapon is fired.

There is at least one retaining element, preferably two retaining elements, for axially securing the control element in the gas block. The at least one retaining element can be a retaining ring that is mounted axially, which can be placed in a corresponding groove (e.g., an annular groove on the control element). The retaining element can also be in the form of an axial segment that extends radially. The radial extension may be in the shape of a disk or plate, and may form an end section of the control element. When the control element is inserted through the hole, transverse to the direction of firing, there may be two retaining elements which secure the control element in place from the left and right side of the gas block.

A control element that is axially secured and transverse to the direction of firing can be simply rotated about its own axis between the first and second positions.

In another disclosed example, the control element comprises at least one sealing element for the gas channel. The at least one sealing element can be placed in at least one groove formed in the control element, for example. The sealing element can be formed by one or more sealing or piston rings, by way of example. The at least one sealing element seals off the control element (i.e., it prevents propellent gasses from escaping). This may reliably prevent a malfunctioning of the weapon.

To obtain a well-sealed control element, there may be at least one sealing element in front of and behind the bore, or nozzle, in the control element, seen in the axial direction of the control element.

In another disclosed example, the control element can be locked in place in the at least first and second positions by a first detent element supported on a first spring element (e.g., a compression spring or spiral spring). This locking retains the control element in the at least first or second position, such that it can only be moved by overcoming the spring force of the spring element. Known notches or snap-in devices can be used to lock the control element in place, in which a mechanism snaps in place in the at least first or second position and remains in that specific position.

In some examples, there is a first spring-loaded detent element which is designed such that this first detent element is moved axially against the force of the first spring element when the control element is rotated from the at least first or second position toward the other position, and when the other position has been reached, allows an axial movement of the first detent element caused by the force of the first spring element.

In some examples, the control element has a first bearing surface with at least two recesses for this that can be brought into, or is in contact with the first detent element. A recess can be a through hole or a hole with a limited depth that does not pass entirely through the component. A hole with a limited depth is also referred to as a blind hole. The at least two recesses may be located at a radial end of a retaining element, which forms as a partial disk or plate.

The recesses are located at a specific angular spacing. The at least two recesses preferably exhibit an angular spacing to one another that lies between 30° and 90°. For example, the angular spacing may be between 45° and 80°, or between 60° and 75°, or 70°.

To simplify the locking in place and releasing therefrom, the recesses, as well as the end of the detent element that locks in place in the recesses, are pointed or conical.

As an alternative or a supplement to the locking in place, example gas blocks disclosed herein may have a limiter that limits the rotation of the control element. As such, the control element can have one or more, preferably two, stops, which bear on a corresponding stop surface on the gas block after a certain rotation. This prevents the control element with the corresponding recess from being rotated past the detent element.

In some examples, there is a blind hole in which the first detent element and the first spring element are at least partially received. The end of the detent element that clicks in place in the recesses in the bearing surface on the control element extends out of the blind hole. In particular, the axis of the blind hole can be parallel to the hole in the control element.

Because the movement of the control element is a guided movement, there is no need for a guide rail or guide groove connecting the individual recesses. It may be useful, however, to connect the recesses by means of a guide rail or guide groove in some examples, in order to enable a controlled guidance of the bearing surface when it is in contact with the detent element.

The control element has at least one operating element with which it can be moved without tools and/or with at least one tool inserted into a socket thereon, in particular on the left and/or right side of the gas block. The tool socket can be designed for a specific screwdriver profile, in particular as a hex socket. It can also be designed for other profiles such as a standard or Philips head screwdriver.

In some examples, the gas block comprises a gas adjustment device at the end of the gas block that extends toward the muzzle, which encompasses a section of the gas block extending toward the muzzle, and which can be brought into a fluid-tight connection with a gas discharge nozzle on the gas block for gas discharge.

The gas adjustment device can be operated and locked in place in at least two gas regulating settings. In some examples, there is a second detent element on a second spring element in the gas block that can be brought in contact with the gas adjustment device, and at least two latching grooves in which the second detent element can engage on the gas adjustment device, such that the gas adjustment device can be locked in place in at least a first gas regulating setting and at least a second gas regulating setting by rotating it about its own axis.

One of the at least two gas regulating settings may be intended for operation with a signature suppressor. In this position, the gas adjustment device is in a fluid-tight connection with the gas discharge nozzle in the gas block. The other regulating setting of the at least two is for operation without a signature suppressor in particular, so-called normal operation. In this setting, there is no fluid-tight connection between the gas adjustment device and the gas discharge nozzle.

The at least two latching grooves preferably form a dead stop and latching surface for the second detent element on the circumference of an end surface of the gas adjustment device. The respective dead stop interacting with the second detent element then prevents a turning of the gas adjustment device in one of the directions in a form-fitting manner, while the respective latching surface interacting with the second detent element allows the second detent element to be pressed down, which allows the gas adjustment device to be rotated in the other direction.

Starting from one of the at least two gas regulating settings, the second detent element is snapped into one of the at least two latching grooves (i.e. it engages in one of the two latching grooves). Because of the dimensions and/or geometry of the respective latching groove and the detent element, the gas adjustment device can only be turned in one of two directions from this position, in order to switch the gas adjustment device to the other gas regulating setting. It can then only be turned in the other direction until the detent element comes in contact with the dead stop. Consequently, further turning is prevented in a form-fitting manner by the interaction of the detent element with the dead stop.

Unlike the dead stop, the latching surface in the other direction is designed such that it is possible to turn the gas adjustment device. A sloped bearing surface on the gas adjustment device therefore allows a turning of the gas adjustment device counter to the force of the spring element acting toward the muzzle. As a result, the gas adjustment device can be moved to the other gas regulating switching position as a result of the interaction of the detent element with the bearing surface.

To facilitate switching from one gas regulating setting to the other, the latching surface may be sloped, and the end of the detent element engaging in the latching groove is conical, with a rounded or pointed end.

The example gas block may have a guide element at its end extending toward the muzzle, and the gas adjustment device has a complementary guide segment that can be inserted into the guide element, which then prevents an axial movement of the gas adjustment device toward the muzzle in a form-fitting manner when it is inserted therein.

The retaining device described above secures the gas adjustment device in a form-fitting manner in both the axial direction and in the circumferential direction, and also allows for the setting of the gas adjustment device to be switched without tools.

The guide element may be formed by at least one guide groove on an axial projection at the end of the gas block extending toward the muzzle, and is coaxial to the segment at the end extending toward the muzzle, and when the guide segment is formed by a complementary radial projection on the gas adjustment device, it can be inserted in an insertion section of the guide groove. The insertion in the insertion section of the guide groove can take place in the circumferential direction in particular.

In order to releasably couple the gas adjustment device to the gas block, the gas adjustment device can be slid axially onto the segment extending toward the muzzle and rotated about the longitudinal axis such that a bearing surface on the gas adjustment device first presses against the second detent element counter to the force of the second spring element, and the turning in one of the two directions allows the second detent element to engage in one of the two latching grooves with the force of the second spring element.

To release the gas adjustment device, the second detent element can be pressed counter to the force of the second spring element, and the gas adjustment device can be turned in of the two directions while the detent element is pressed inward.

The axial projection at the end of the gas block extending toward the muzzle may be designed as a barrier, which prevents pushing against the detent element with a fingertip, but allows it to be pressed down using an appropriate tool. This prevents an unintentional releasing of the gas adjustment device with a fingertip.

The gas adjustment device described above is part of the gas block described above, which has the control element according to the teachings of this disclosure. The gas adjustment device can also be used with a gas block that does not have the disclosed control element, or that has a control element other than the disclosed control element.

As a result, an example gas block can be provided for a firearm in which the gas block comprises:

a gas adjustment device at the end of the gas block extending toward the muzzle, which encompasses a segment at the end of the gas block extending toward the muzzle, and can be brought into a fluid-tight connection with a gas discharge nozzle, in which the gas adjustment device can be releasably coupled to the gas block with an attachment device, characterized in that:

there is a detent element in the gas block supported on a spring element, which can be brought in contact with the gas adjustment device, and there are at least two latching grooves on the gas adjustment device that can be brought into engagement with the detent element, such that the gas adjustment device can be locked in place in at least a first gas regulating setting and in at least a second gas regulating setting by turning it about its own axis.

Such an example gas block can comprise a mount for attaching the gas block to a gun barrel, a gas cylinder that can be connected in a fluid-tight manner to a hole in the gun barrel via a gas channel, and a gas piston that can be moved longitudinally in the gas cylinder to drive a gas-operated reloading mechanism.

This example gas block can be further improved according to the teachings of the disclosure by the features explained above relating to the example gas adjustment device.

In another disclosed example, there is a control element for a gas block for opening and closing a fluid-tight connection between the gas cylinder in the gas block and the hole in the gun barrel on a firearm. The control element can be a nozzle with a bore that is transverse to the longitudinal direction of the nozzle body.

In some examples, the nozzle may have at least one groove for at least one sealing means. In other examples, the nozzle may have two grooves for at least two sealing means. The two grooves for the at least two sealing means may be placed such that the bore is located axially between the two grooves. The at least one sealing means may be in the form of one or more sealing or piston rings.

Furthermore, the control element may have at least one retaining element, or, in some examples, two retaining elements, with which the control element is axially secured in place on or in the gas block. The retaining element can be in the form of a retaining ring, for example, which is preferably placed in a groove. Instead of a retaining ring, the retaining element can be formed by a segment of the control element itself (e.g., a radially extending segment, preferably in the form of a disk or plate). The at least one retaining element can form the end of an axial end of the control element in particular. When it is in the form of a disk or plate, there is no need for a groove.

A retaining ring may be used at the one axial end of the control element, and a disk-shaped end segment may be used at the other axial end of the control element.

In some examples, the control element may have a socket for a tool. This makes it possible to set the control element using an appropriate tool. Alternatively or in combination with the tool socket, there can also be an operating element for a manual setting of the control element.

In some examples, the at least one retaining element may have at least two recesses in which a spring-loaded detent element can snap in place. The at least two recesses are preferably located on a radial end of the retaining element designed as a partial disk or plate.

The at least two recesses have an angular spacing that lies between 30° and 90°. For example, the angular spacing may be between 45° and 80°, or between 60° and 75°, or 70°.

To make it easy to snap it in place or remove it, the at least two recesses are conical.

According to a third example, a gun barrel is obtained that has the gas block described above, or the control element described above.

According to a fourth example, a firearm is provided, in particular a machine gun or an assault rifle, which has the gas block described above or the control element described above, or which has the gun barrel described above.

The firearm may comprise a gas piston rod that can be releasably coupled to the gas block, and a breechblock assembly coupled to the gas piston rod that can move longitudinally in the receiver.

Turning now to the figures, the structure of the automatic firearm according to the teachings of this disclosure shall first be explained in reference to FIG. 1. FIG. 1 shows an example side view of the automatic firearm 1 from the right side.

The automatic firearm is an automatic rifle in this case, in the form of an assault rifle (HK 417), and substantially comprises the following elements: a gun barrel 2 with an example gas block 5 mounted thereon, and a flash suppressor 3, a receiver 4 in which the gun barrel 2 is placed; a hand guard (not shown) coupled to the receiver 4, and a handle 7 mounted on the receiver 4. There are also a loading mechanism and a breechblock assembly 8 in the receiver 4. The rifle 1 also has a butt stock 9.

The individual assemblies or parts and their functions are known per se, with the exception of the example gas block 5 that is disclosed in the examples described herein. The functioning thereof are comprehensively described in DE 10 2017 002 242 A1 by the applicant, which is incorporated herein by reference in its entirety. While DE 10 2017 002 242 A1 describes the functioning in reference to an HK 433 assault rifle, example gas blocks disclosed herein may be used in conjunction with other types of firearms.

Figure 2:
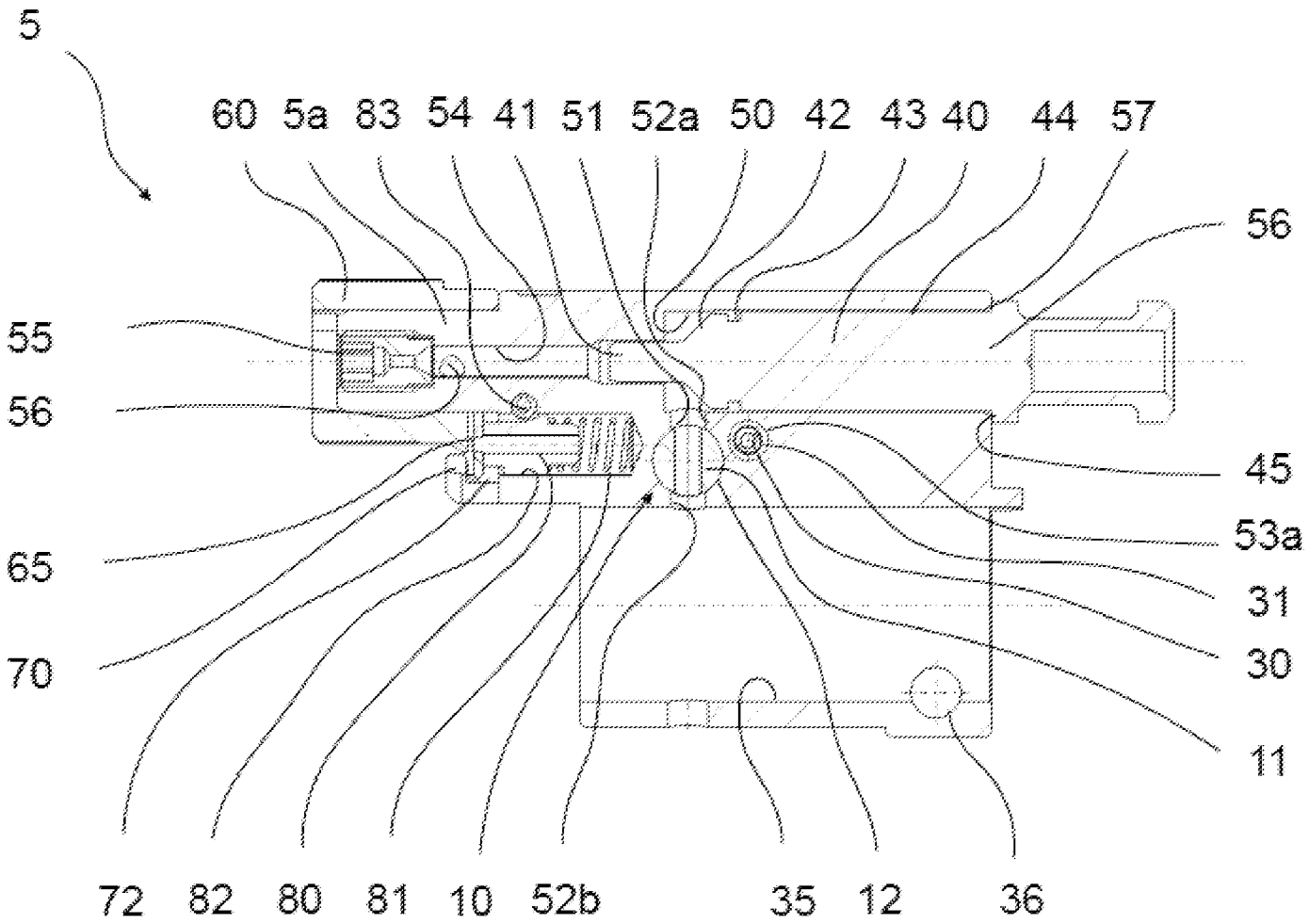
FIG. 2 shows an example side view of a gas block for the firearm in FIG. 1 in the assembled state.

FIG. 2 shows an example longitudinal cross section of the gas block. The example gas block 5 comprises a cylindrical tubular bearing 35 that can be mounted on the gun barrel 2. The flash suppressor 3 is removed for this, and the example gas block 5 is then slid over the barrel. There is a transverse hole 36 through which a transverse pin can be inserted to secure the example gas block 5 in place. The example gas block 5 comprises a gas cylinder 50 that can be connected to a hole in the gun barrel 2 in a fluid-tight manner via a gas channel 51. The gas channel 51 is formed in this example by two gas channel parts 52*a*, 52*b*, which are flush when fitted together.

The gas block also has a gas piston 40 that can move longitudinally in the gas cylinder 50 for driving a gas-operated reloading mechanism. The gas piston 40 is in the form of a short-stroke gas piston. The short-stroke gas piston 40 comprises a gas piston lug or valve pin 41 at its front end, extending toward the muzzle, for longitudinal guidance and sealing in a two-stage gas passage 45, which extends toward the muzzle in an extension of the gas cylinder 50. The gas passage 54 ends in a gas discharge nozzle 55, through which the propellant gasses can be discharged toward the muzzle. The valve pin 41 is conical at its front end so that it can be easily inserted into the gas passage 54. The short-stroke gas piston 40 becomes wider at the back, toward the stock, in a conical section 42, and then transitions into a bearing section 43 with a circumferential annular groove.

The outer dimensions of the bearing section 43 may be complementary to the inner dimensions of the gas cylinder 50. Sealing rings are placed in the groove that seal the short-stroke gas piston 40 against the gas cylinder 50. The bearing section 43 continues toward the stock in a cylindrical section 44, the end of which extends through a hole 56 at the axial end of the gas cylinder 50. The outer dimensions of the cylindrical section 44 remain substantially complementary to the inner dimensions of the gas cylinder 50. The gas piston 40 also has a stop surface 45 for a counter-stop surface 57 formed at the end of the gas cylinder 50 facing the stock that limits the forward movement of the gas piston 40 toward the muzzle.

The functioning of a short-stroke gas piston system is known per se, and there is no need for further explanation thereof.

The example gas block 5 also has a control element 10 that can be moved between two switching positions. There is a hole 53 (shown in FIGS. 3 and 4) in the example gas block 5 for the control element 10, through which the control element 10 is inserted, in a direction transverse to the direction of firing. As can be clearly seen, the control element 10 separates the two parts 52*a*, 52*b* of the gas channel from one another. The control element 10 forms a nozzle with a bore 11 and an outer wall 12.

The control unit 10 can be turned to exactly two switching positions, in which the gas channel 51 is open in the first position, and the gas channel 51 is closed in the second position. In the first position, the bore 11 in the control element 10 connects the two parts 52*a*, 52*b* of the gas channel to one another in a fluid-tight manner, in order to connect the gas cylinder 50 to the hole in the gun barrel in a fluid-tight manner. In the second position, the outer wall 12 interrupts this fluid-tight connection and closes the gas channel 51.

The example gas block 5 also has a first detent element 30, which is supported on a first spring element 31 inside a blind hole 53*a*. The control element 10 can be locked in place in its two switching positions via this spring-loaded detent element 30. Structural details regarding the control element 110 and the first detent element 30 are discussed further in connection with FIGS. 10 to 14.

The example gas block 5 can be shut off with the control element 10. The propellant gasses can be diverted in the first position, which can also be referred to as the open position, such that the breechblock assembly is moved backward in the known manner. It is only possible to operate the firearm in the single-shot mode in the second position, which can also be referred to as the closed position (i.e., the ammunition must be loaded via a manual mechanism). Such a mechanism is well known and requires no further explanation.

The disclosed example gas block 5 can prevent malfunctioning of the weapon. For example, the example gas block 5 may prevent malfunctioning when the weapon is fired using subsonic ammunition. Another advantage lies in the prevention and/or reduction of noise emissions that occur during reloading. The control element can also be switched quickly and precisely, in order to open or close the gas block.

The example gas block 5 also has an example gas adjustment device 6. The example gas adjustment device 6 comprises a sleeve-shaped body 60, that is slid over the end 5*a* of the example gas block 5 extending toward the muzzle, and then turned about its axis to assume one of the two gas regulating positions. The gas adjustment device has two gas discharge openings 66, 67 that can be brought into alignment with the gas discharge channels 58, 59 at the section 5*a* extending toward the muzzle. The propellant gasses can be discharged into the environment through these openings.

In theory, any plug-in-and-twist connection can be used to couple the gas adjustment device to the gas block.

In order to lock the example gas adjustment device 6 in one of the two gas regulating settings, there is a second detent element 80 in the example gas block 5 supported on a second spring element 81, which is connected to the example gas adjustment device 6, or can be brought into contact with the sleeve 60. There are at least two latching grooves 61, 62 (shown in FIGS. 15 and 16) on the example gas adjustment device 6 that are complementary thereto, which can be brought into engagement with the second detent element 80. The example gas adjustment device 6 is in the second gas regulating position (i.e., the second detent element 80 is snapped into the latching groove 62, or engaged therein).

The axis of second detent element 80 used for this locking in place is parallel to the direction of firing, and it is supported on the second spring element 81 in a second blind hole 82, and secured in place by means of a pin 83 that is transverse to the direction of firing. The pin 83 (shown in FIG. 3) is inserted in a hole 84 (shown in FIG. 4) that is transverse to the blind hole 82. The hole 84 passes partially through the blind hole 82, and the axis of the hole 84 lies above the blind hole 82. In an alternative example, not shown herein, the axis of the hole 84 runs below the blind hole 82.

The transverse pin 83 secures the detent element 80 in that the axial movement path is limited toward the front. Movement of the detent element 80 toward the back (i.e., counter to the force of the spring element 81 is not prevented by the transverse pin 83). This results in a simple assembly and a controlled insertion and removal of the detent element into and out of the respective latching grooves 61, 62. To install the second detent element 80, the spring element 81 and the detent element 80 are first inserted into the blind hole 82 against the force of the spring element 81. In this compressed state, the transverse pin 83 can be inserted in the hole 84. To release it, the detent element 80 must first be pressed against the force of the spring element 81 before the transverse pin 83 can be removed.

As can be readily seen in the following FIGS. 3 and 4, the second detent element 80 is beveled off at the top on its end extending toward the muzzle in order to form a bearing surface 85 on the second detent element 80. When it has been inserted, enough pressure is exerted on the transverse pin 83 by the second detent element 80 to ensure that it will not slip out of the hole 84 unintentionally. This results in a simple retaining element, which also allows for longitudinal movement of the detent element 80 so that it can click into and out of the latching grooves 61, 62 in the gas adjustment device.

Figure 15:
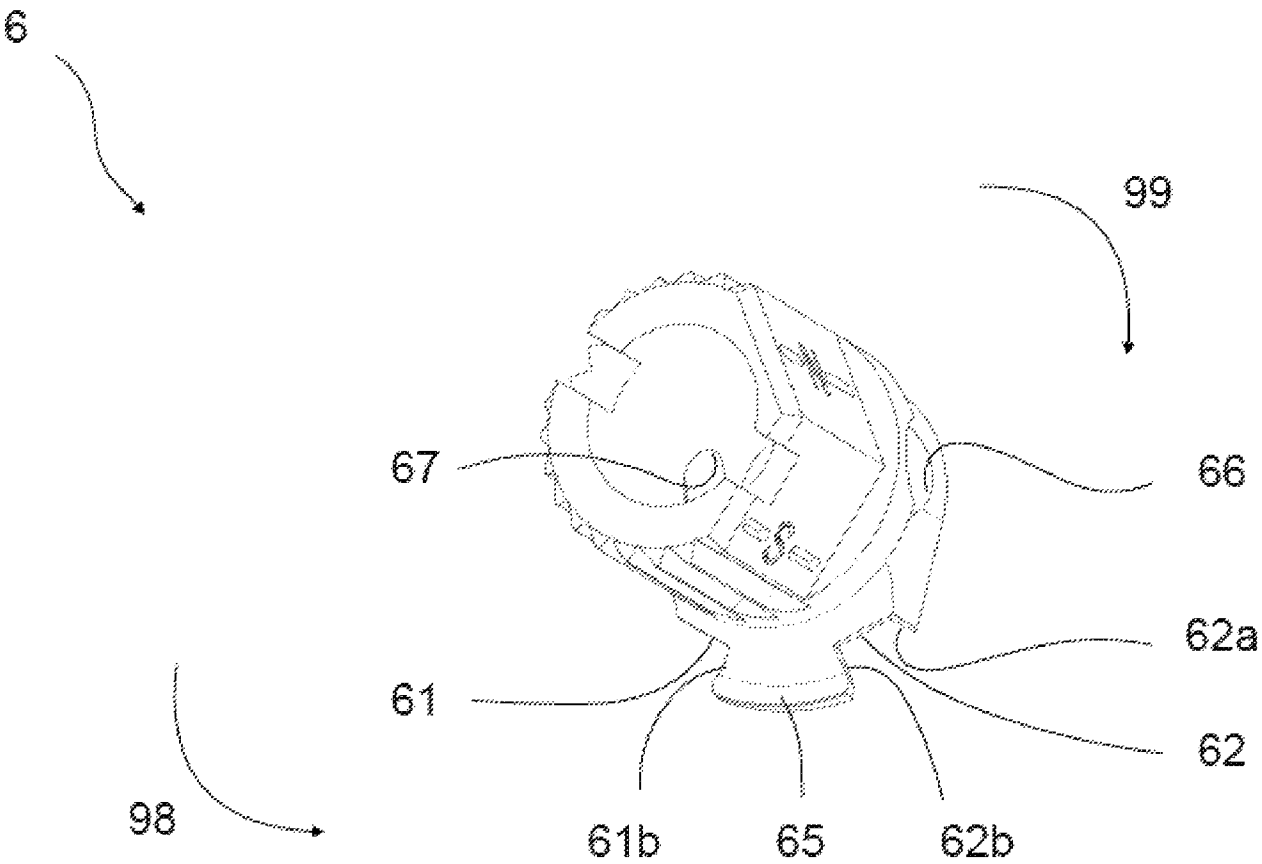
FIG. 15 shows an example perspective view of the gas adjustment device in FIG. 2 from the front.
Figure 16:
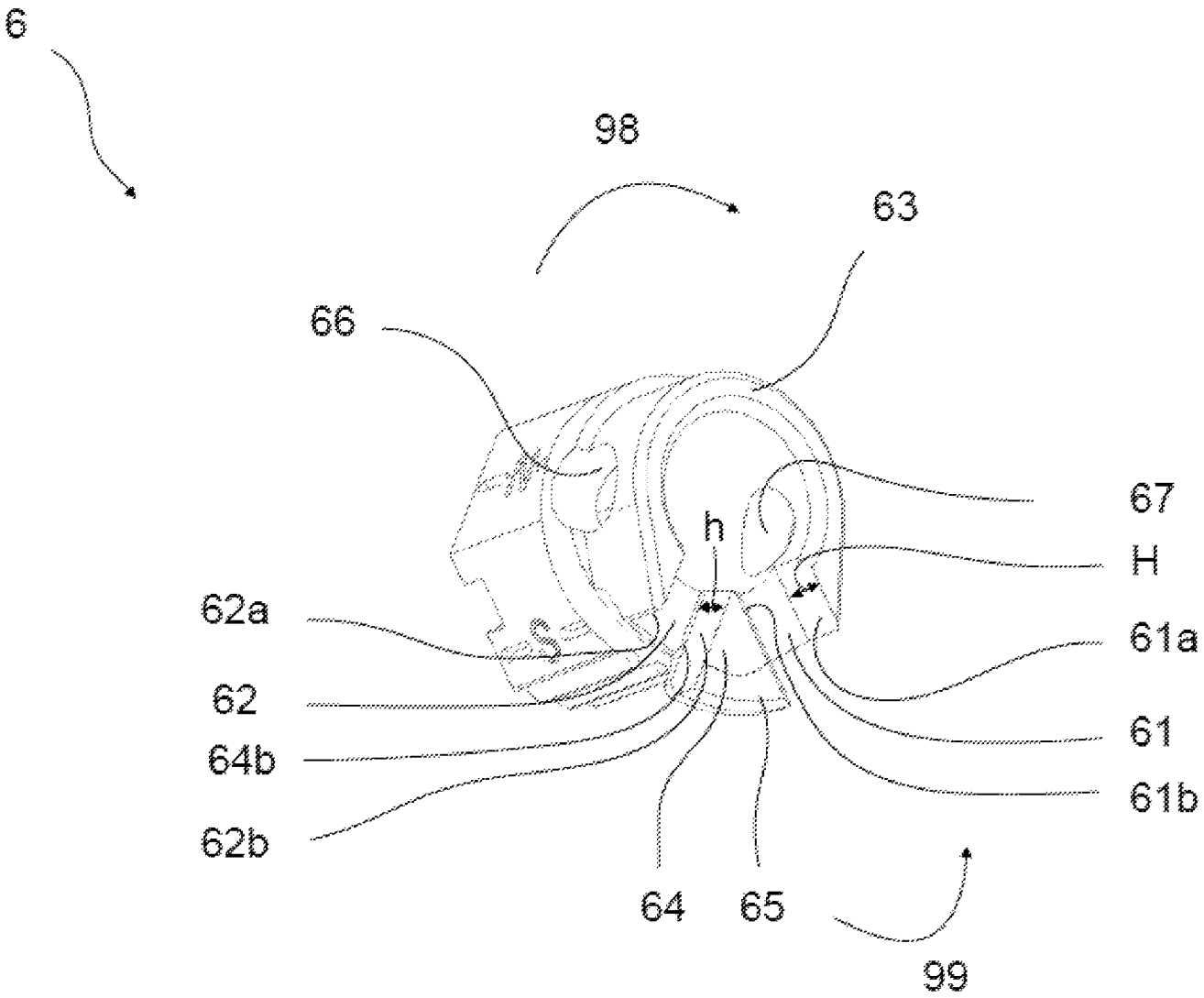
FIG. 16 shows an example perspective view of the gas adjustment device in FIG. 15 from the back.

Structural details of the gas adjustment device, in particular the plug-in-and-turn connection, are discussed further in connection with FIGS. 15 and 16.

Figure 3:
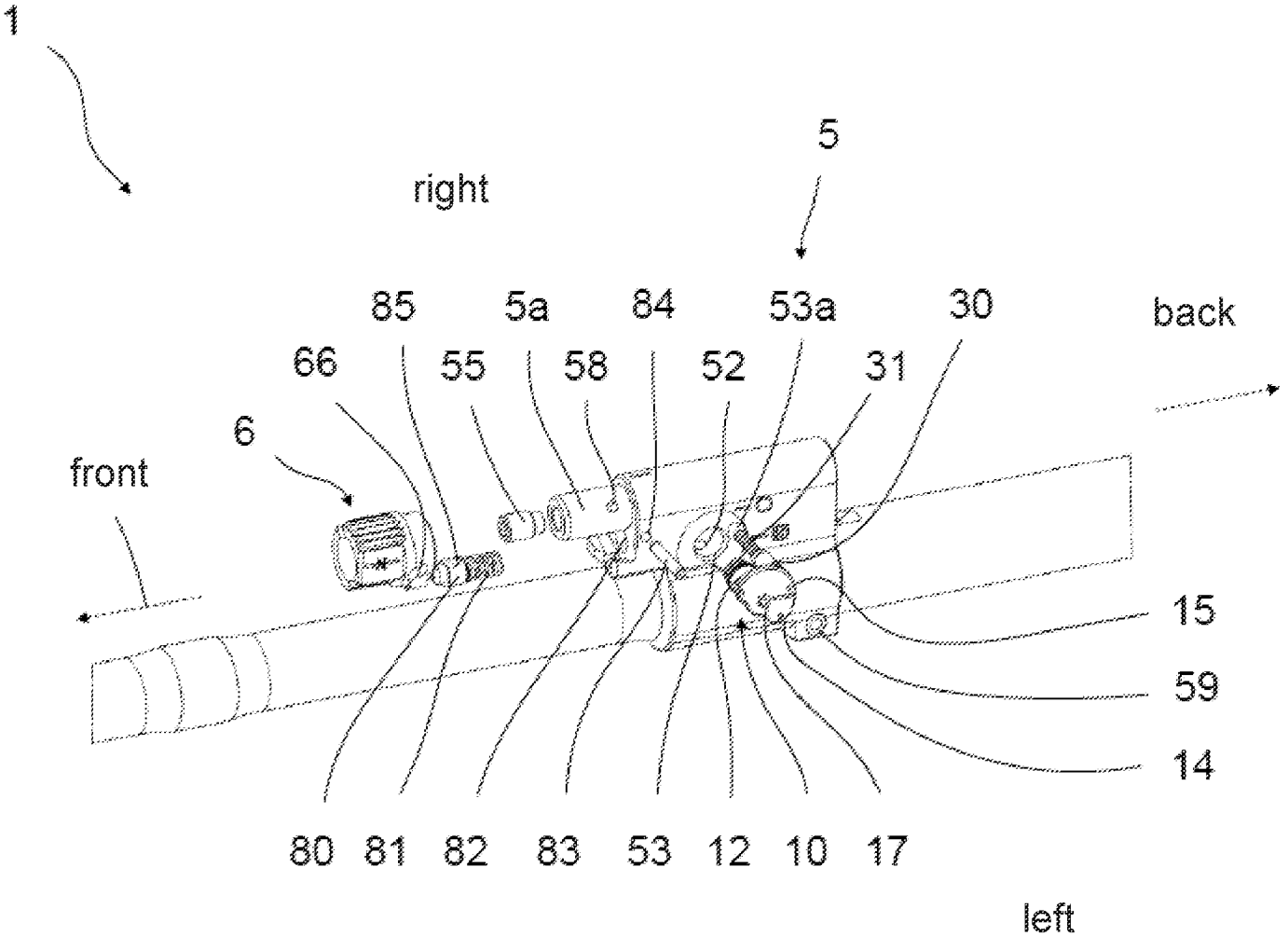
FIGS. 3, 4 show example perspective views of the gas block in FIG. 2 from the left and right sides.
Figure 4:
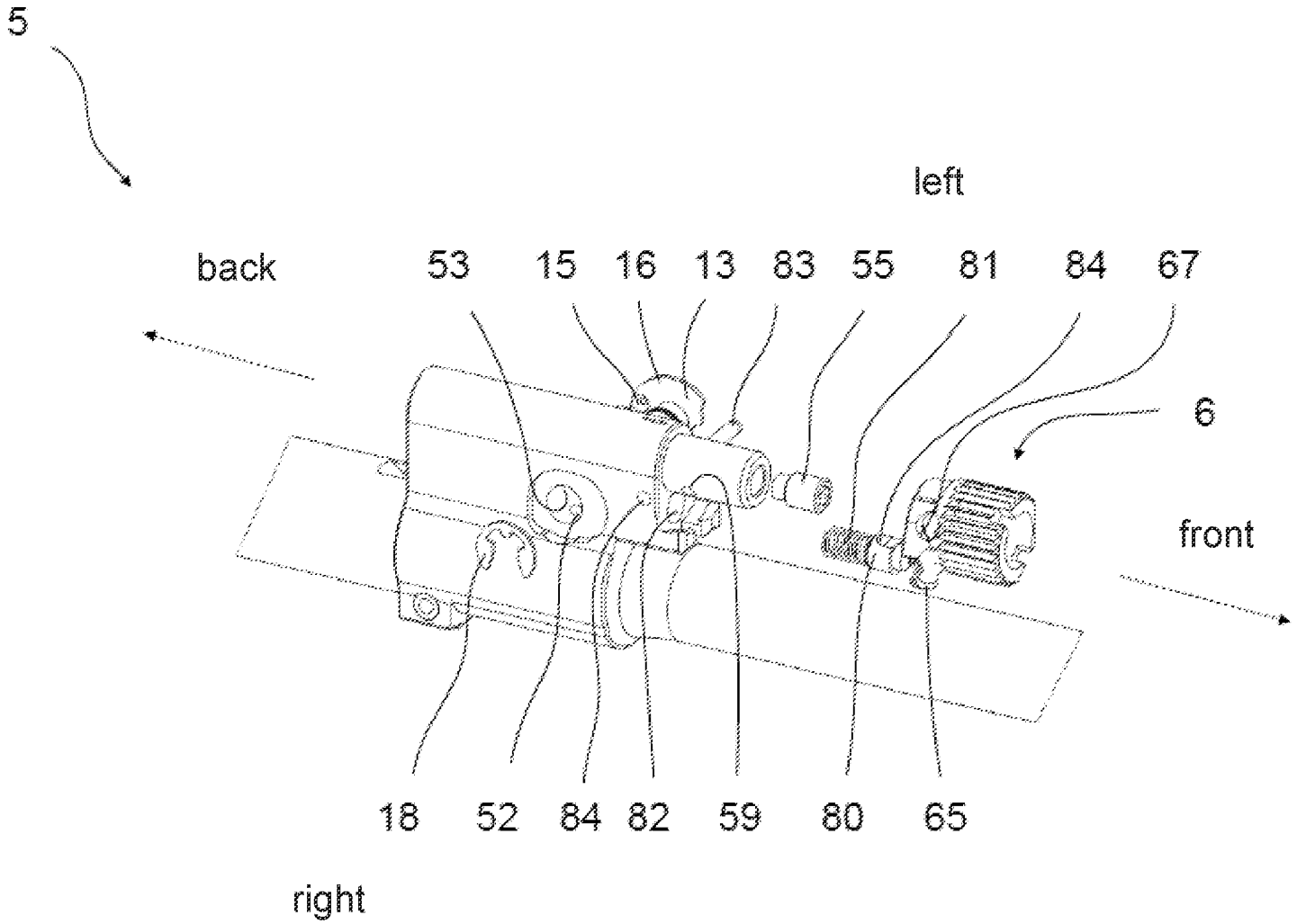

FIGS. 3 and 4 show the example gas block 5 in an example exploded view from the left and right sides respectively.

It can be seen in particular in FIGS. 3 and 4 that the control element 10 has a bearing surface 13 connected to the left end of the control element 10 and in contact with the detent element 30, which has two recesses 14, 15 that correspond to the detent element 30, into which the detent element 30 can snap in place. The bearing surface 13 is formed by the end surface of a disk-shaped end section 16 of the control element 10 facing toward the example gas block 5. The axis of the blind hole 53*a* is parallel to the hole 53 such that the axis of the detent element 30 can also be parallel to the control element 10.

Figure 5:
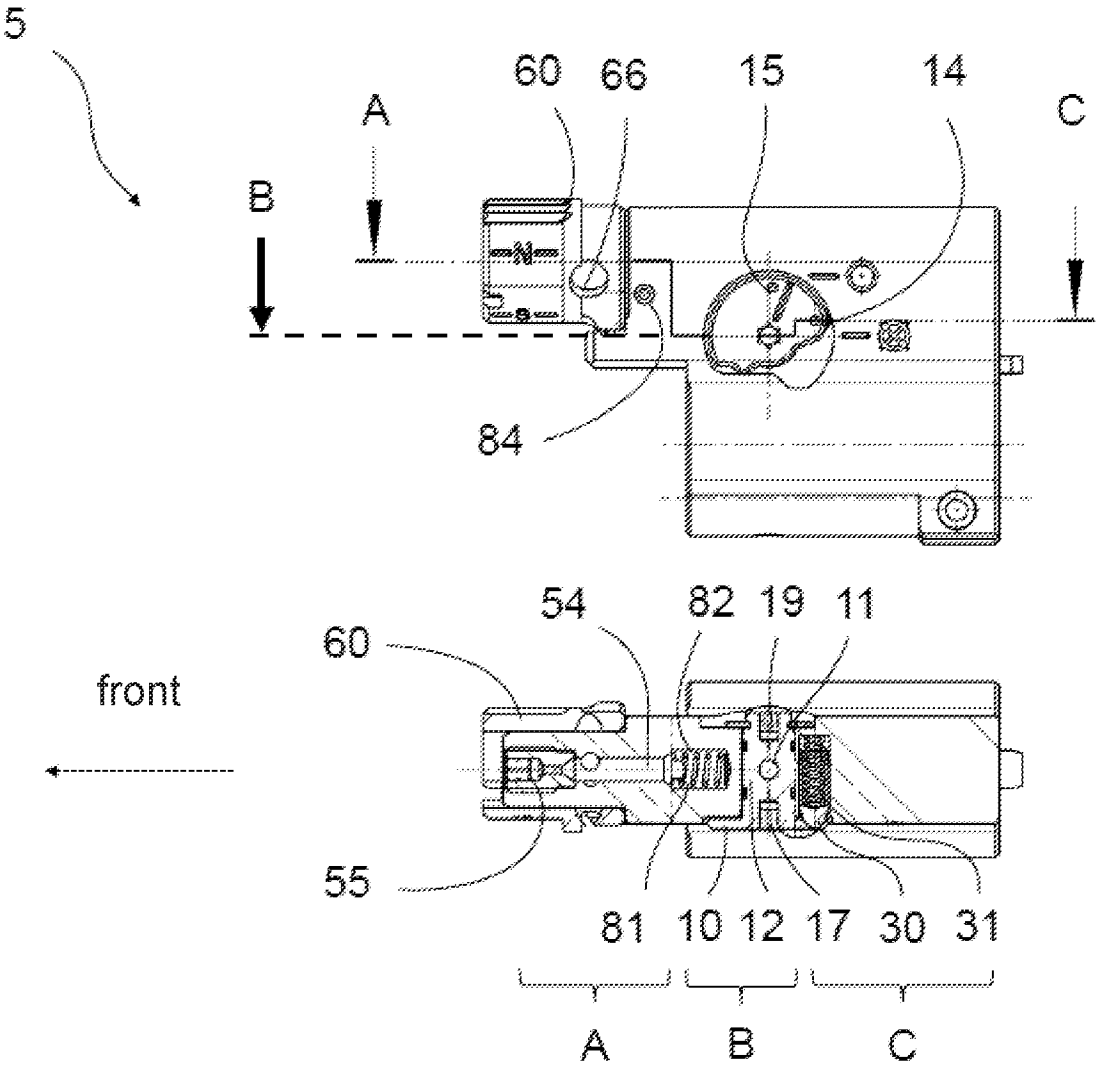
FIG. 5 shows further example cross sections of the gas block in FIGS. 2 to 4 when the control element is open, and from above when the control element is open.

FIG. 5 shows the example gas block 5 in three example cross sections A, B, C, and from above.

Cross section A runs longitudinally through the sleeve 60, the section 5*a* extending toward the muzzle, and through the axis of the gas passage 54. Cross section A is located above the hole 84. Cross section A exposes the front end of the gas passage 54 and the gas discharge nozzle 55, and allows for a view from above, as can be seen in the lower image.

Cross section B runs longitudinally and partially along the axis of the blind hole 82 and along the axis of the control element 10. Cross section B first exposes the second spring element 81 seen from the front, which is received in the blind hole 82. It can be readily seen that the blind hole 82 and therefore the spring element 81 are in the middle of the example gas block 5 and parallel to the direction of firing.

Cross section B also exposes the "inner workings" of the control element 10. It can be readily seen how the hole 11 runs from the "top down" to connect the two gas channel parts 52*a*, 52*b* to one another in a fluid-tight manner, and to thus open the gas channel 51. The control element 10 is then in the first position. The first position is indicated by an "empty circle" and the second position is indicated by a "circle with a cross" on the left side of the gas block. Two tool sockets 17, 19 are formed on the respective axial ends of the control element 10, in the form of hex sockets (shown in FIG. 14).

Cross section C runs, seen radially, above cross section B and below cross section A, longitudinally through the axis of the first detent element 30 and the first spring element 31. The detent element 30 is snapped in place in the first recess 14 in the first position.

FIG. 6 shows the example gas block 5 in FIG. 5 in a cross section D and from the front. The cross section D is a cross section through the example gas block 5 and runs along the axis of the control element 10 and through the hole 11.

In the image on the right it can be seen how the hole 11 in the control element 10 connects the two gas channel parts 52*a*, 52*b* with one another so that the propellant gasses can be diverted. The second recess 15 can also be readily seen. Sealing rings 26 and 27 (shown in FIG. 7) have been placed to the left and right of, or in front of and behind the hole 11, which seal the control element 10.

In the image on the left it can be seen that the disk-shaped end section 16 also has two stops 20 and 22, which extend in opposing directions along the circumference. The example gas block 5 also has two corresponding stop surfaces 21 and 23. The one stop 20 bears on the stop surface 21 in the first position, as shown in the image on the left. The other stop 22 bears on the stop surface 23 in the second position, as shown in FIG. 7. The gas block 5 includes a recess 100 that accepts the control element 10. The recess 100 of the gas block 5 includes the stop surfaces 21 and 23.

The stops 20, 22 limit the pivot or turning range of the control element 10 by interacting with the stop surfaces 21, 23, and prevent the respective recesses 14 or 15 from being turned past the tip of the detent element 30. In other words, the control element 10 can only be rotated back and forth between the first and second positions.

FIG. 7 shows the example gas block 5 from FIG. 6 in the same cross section D, in which the control element 10 is in the second position. The outer wall 12 closes off the gas channel 51 in this position. The detent element 30 is snapped into the second recess 15 in the second position. Other than the foregoing differences, FIG. 7 corresponds to FIG. 6 such that reference can be made to the explanations thereto.

Figure 8:
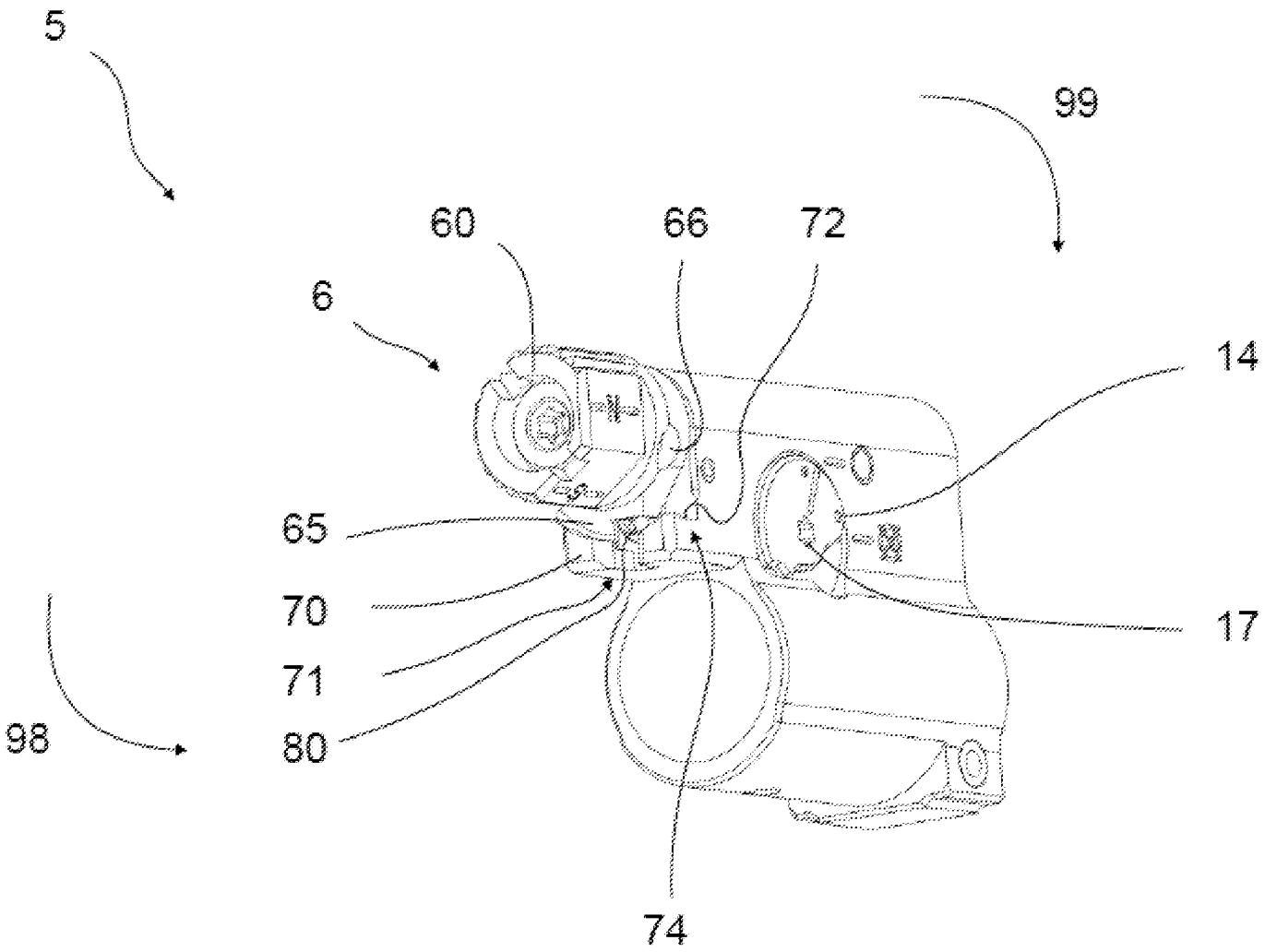
FIG. 8 shows an example perspective view of the gas block from the left side when the control element is open.
Figure 9:
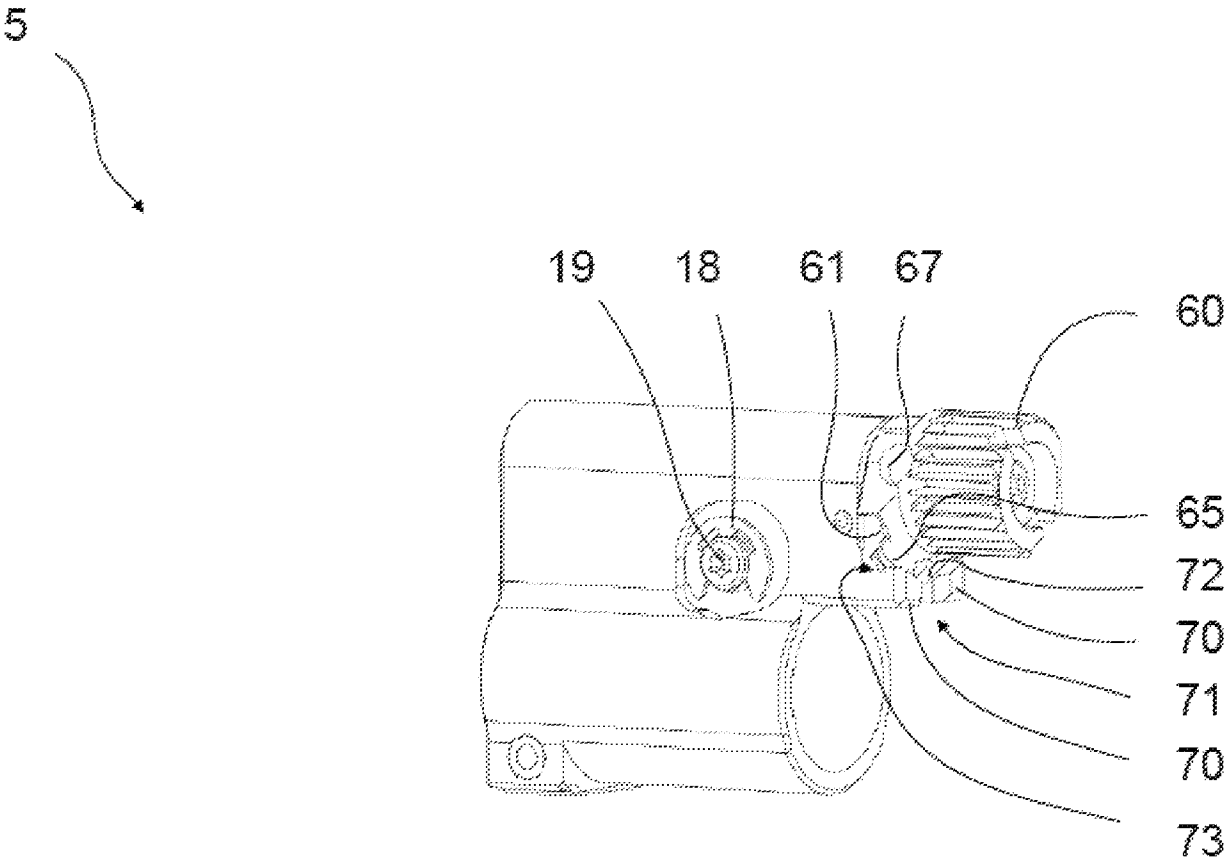
FIG. 9 shows an example perspective view of the gas block in FIG. 8 form the right side.

FIGS. 8 and 9 show perspective views of the example gas block 5 described above from the left and right sides, in which the control element 10 is in the first position (i.e., the first detent element 30 is snapped into the recess 14).

As specified above, the example as block 5 has an example gas adjustment device 6 that can be switched between two gas regulating settings. The second detent element 80 is snapped into the second latching groove 62. This results in the gas passage channels 58, 59 being closed by the inside sleeve 60. This corresponds to the second gas regulating setting.

The sleeve 60 is secured against unintentional release in both the axial direction and in the direction in which it rotates about its own axis.

The example gas block 5 has a guide element at its end extending toward the muzzle, which is formed in this case by an axial projection 70, which is interrupted in the middle by a cut-out, and a guide groove 72 formed in the projection 70, in which the groove 72 is substantially coaxial to the section 5*a* toward the muzzle surrounded by the sleeve 60. The guide groove 72 forms a contact surface on which a part of an end surface of the guide segment 65 on the sleeve 60 can bear in order to prevent axial movement of the sleeve 6 toward the muzzle.

The guide groove 72 has an insertion section 73 (on the right) and 74 (on the left) at each end along the circumference. The guide segment 65 of the example gas adjustment device 6 can be inserted, or twisted into, these respective sections 73, 74.

The latching grooves 61, 62 each have dead stops 61*a*, 62*a* acting in the circumferential direction (shown in FIGS. 15 and 16). By interacting with the detent element 80, a turning of the example gas adjustment device 6 in the direction 99 (starting from the second gas regulating setting) is prevented in a form-fitting manner.

In the other respective circumferential directions, the latching grooves 61, 62 border on a latching surface 61*b*, 62*b* (shown in FIGS. 15 and 16). When a user rotates the sleeve 60 in one direction 98 (starting from the second gas regulating setting) to change the gas regulating setting, the latching surface 62*b* is first brought into contact with the detent element 80 if it is not already in contact with the detent element 80. When the turning force is maintained, the detent element 80 is subjected to an axial force and pressed into the blind hole 82, counter to the spring force of the second spring element 81. It is then possible to move the sleeve 80 into the first gas regulating setting.

Further structural details and explanations regarding the example gas adjustment device 6 can are discussed further in connection with FIGS. 15 to 18.

Figure 10:
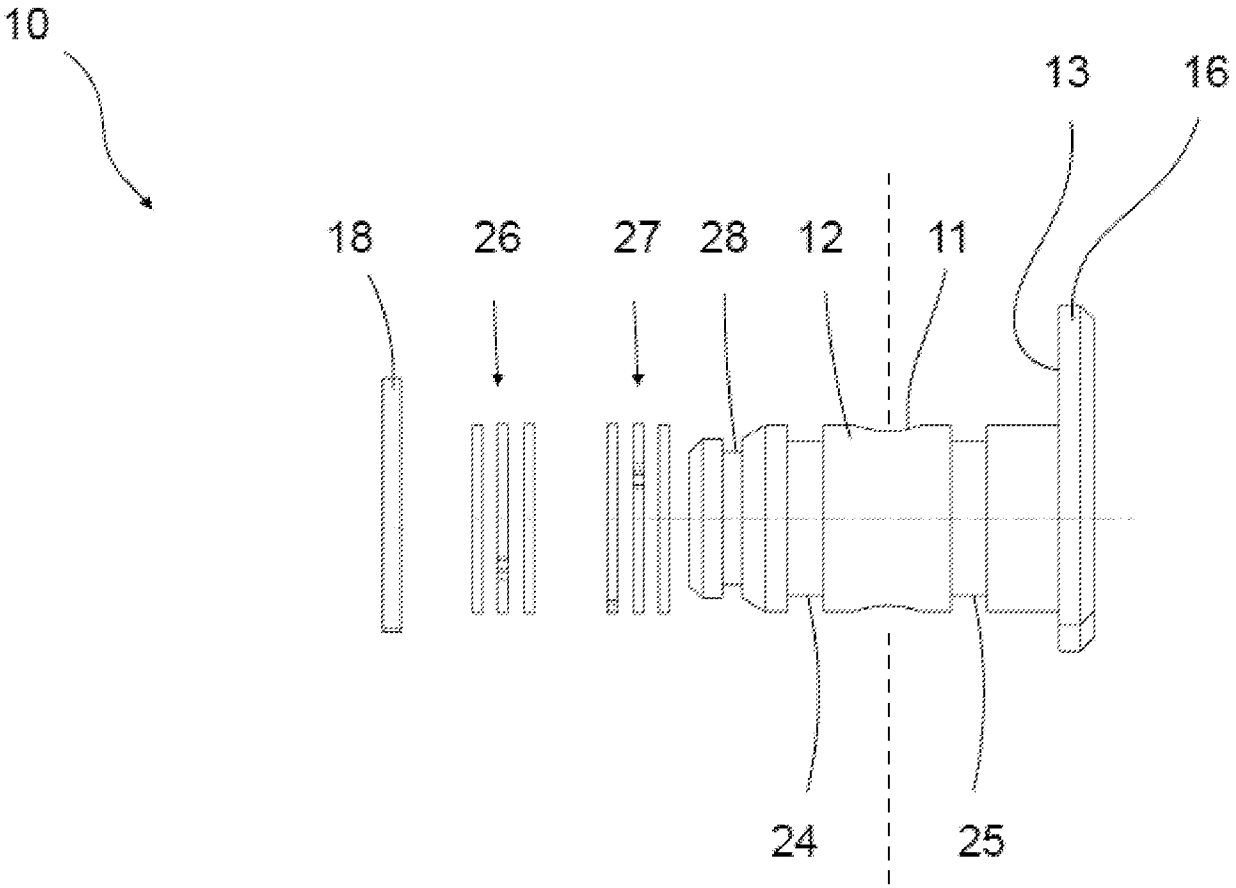
FIG. 10 shows an example side view of the control element in FIG. 2.

FIG. 10 shows an example side view of the control element 10 described above for opening and closing the fluid-tight connection between the gas cylinder 50 in the example gas block 5 and the hole in the gun barrel 2 on an automatic firearm 1.

The control element 10 forms a nozzle body extending longitudinally that has a bore 11 and an outer wall 12. An end section 16 is formed at its one axial end that extends radially from the axis and is in the shape of a disk. The end section 16 contains the bearing surface 13 facing the example gas block 5, which is not shown. The nozzle body has two grooves 24, 25 for two sealing means 26, 27 in the form of sealing rings, in which the first sealing ring 26 is placed in the first groove 24, and the second sealing ring 27 is placed in the second groove 25. The bore 11 is located axially between the grooves 24 and 25. The control element 10 also has a third groove 28 for a retaining element 18 in the form of a retaining ring. The third groove 28 is located at the axial end away from the end section 16.

Figure 11:
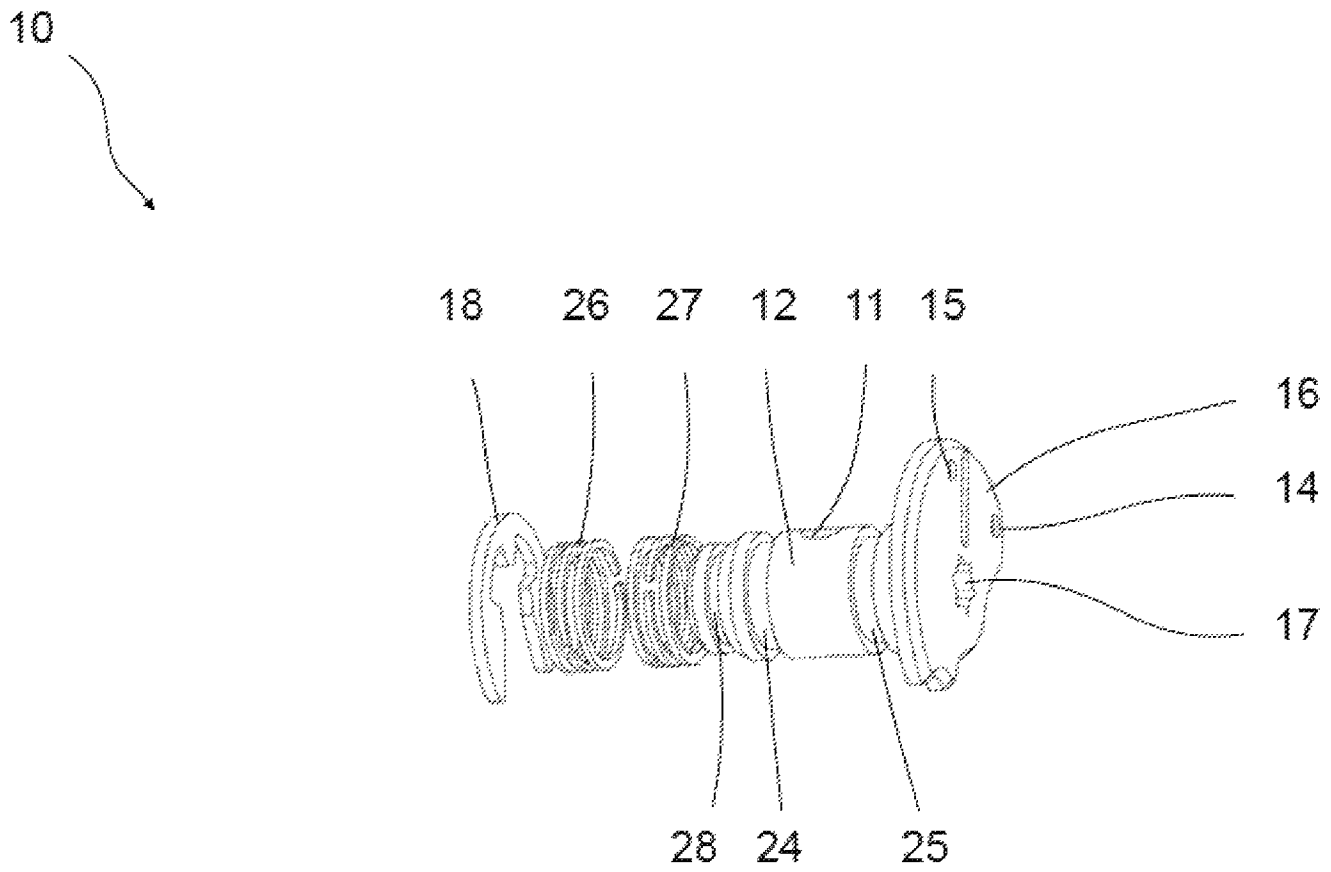
FIG. 11 shows an example exploded view of the control element in FIG. 10.

FIG. 11 shows the control element 10 from FIG. 10 in an example perspective view. The tool socket 17 and the recesses 14, 15 on the end section 16 can be readily seen from this perspective. The two recesses 14, 15 are at an angular spacing to one another of approximately 70°.

Figure 12:
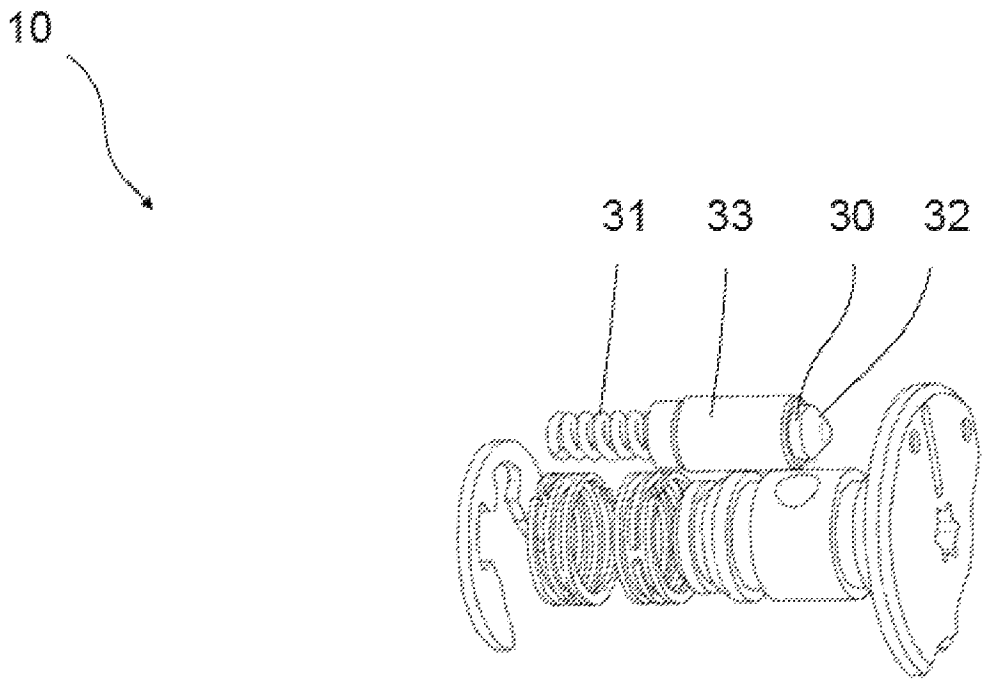
FIG. 12 shows an example first view of the control element in FIG. 11 with a spring element.

FIG. 12 shows the control element 10 from FIG. 11 and the detent element 30 in an example perspective view. The detent element 30 is formed by a solid pin, which has a conical shape at the end 32 facing the bearing surface 13. The detent element 30 and the helical spring element 31 are contained at least in part in a sleeve 33. The sleeve 33 is the same size as the blind hole 53*a* in the example gas block 5.

Figure 13:
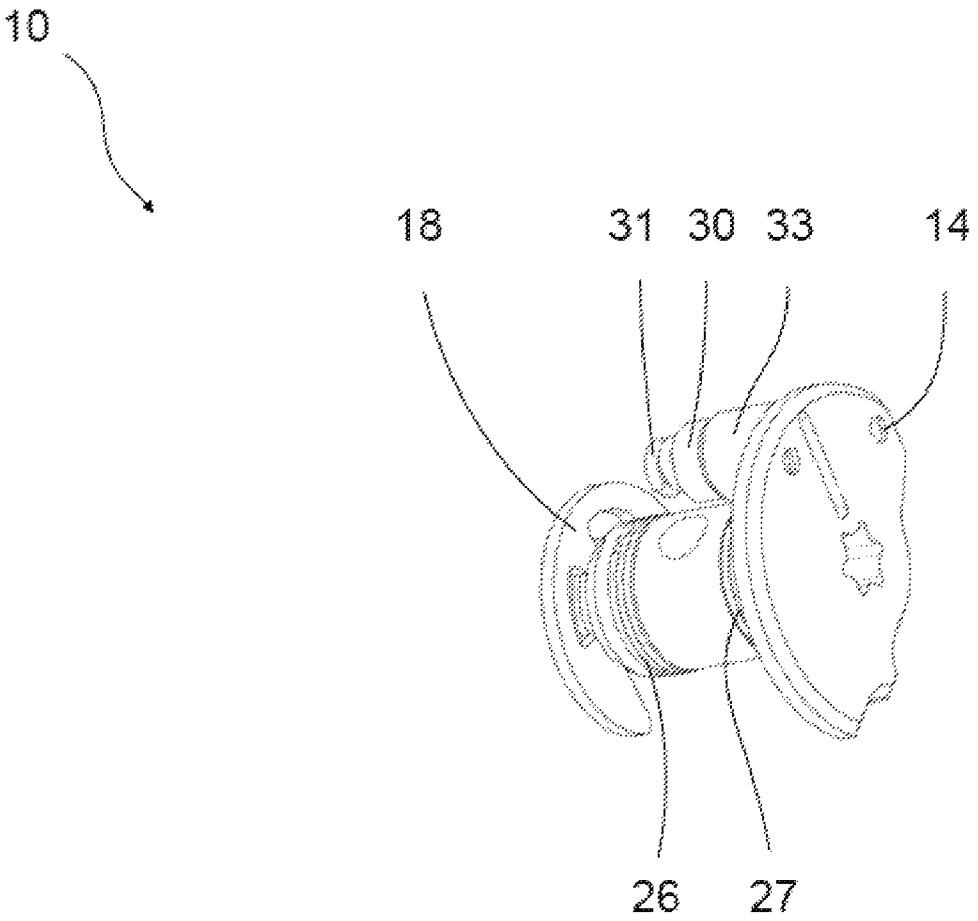
FIG. 13 shows an example second view of the control element and the spring element in FIG. 12.

FIG. 13 shows an example perspective view of the control element 10 and the detent element 30 in FIG. 12 in the assembled state. The detent element 30 is snapped into the recess 14 and the axis thereof is parallel to the that of the control element 10.

Figure 14:
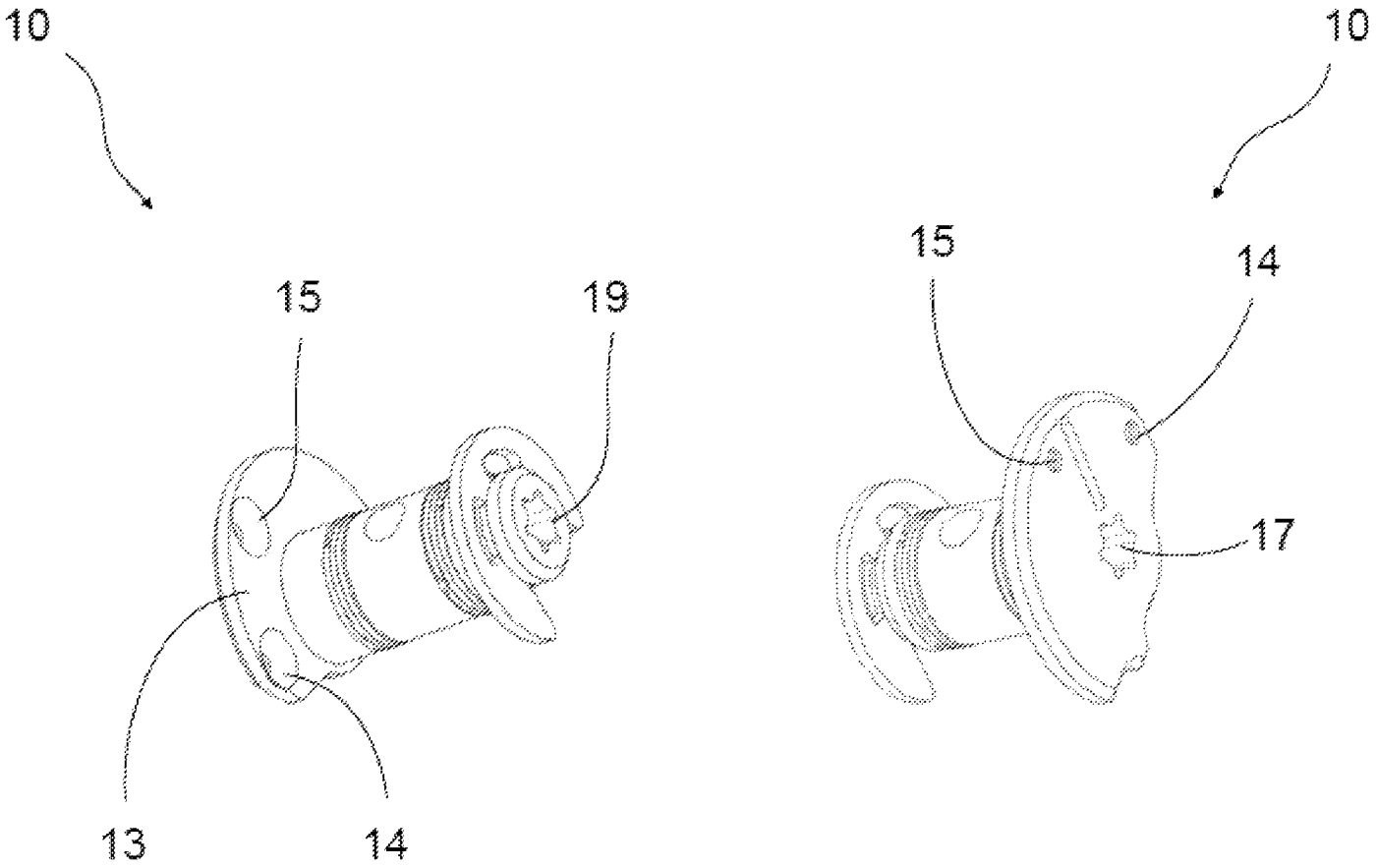
FIG. 14 shows example third and fourth views of the control element in FIGS. 11, 12, and 13.

FIG. 14 shows the control element 10 described in reference to FIGS. 10 to 13 from two different example perspectives. The image on the right shows the control element 10 from the perspective shown in FIGS. 11 to 13, such that reference can be made to the explanations above. The image on the left shows the control element 10 from the other side, illustrating the bearing surface 13 and the tool socket 19. As can be seen therein, the recesses 14, 15 are conical.

FIGS. 15 and 16 show the example gas adjustment device 6 from two example perspectives.

The example gas adjustment device 6 is in the form of a sleeve 60 with two latching grooves 61, 62. The spring-loaded detent element 80 can snap into these two latching grooves 61, 62. When the detent element 80 is snapped into the first latching groove 61, the gas adjustment device is locked in place in the first gas regulating setting. When the detent element 80 is snapped into the second latching groove 62, the gas adjustment device is locked in place in the second gas regulating setting.

The two latching grooves 61, 62 are located on an end surface 63 of the example gas adjustment device 6 at an angular spacing of ca. 55° to one another, and each form a respective dead stop 61*a*, 62*a* and latching surface 61*b*, 62*b* along the circumference. The end surface 63 is also the bearing surface that can be brought to bear on the detent element 80 in order to push down on the detent element 80 during assembly.

The first latching groove 61 forms the dead stop 61*a* with one of its two lateral walls, and the opposing latching surface 61*b* with the other lateral wall. The second latching groove 62 forms the dead stop 62*a* with one of its two lateral walls, and the opposing latching surface 62*b* with the other lateral wall.

Both dead stops 61*a*, 62*a* border on the end, or bearing, surface 63 along the circumference. The latching surfaces 61*b*, 61*b* border on an intermediate piece 64, which is formed between latching grooves 61, 62 where they are closest to one another. The intermediate piece 64 has a triangular cross section, and is axially countersunk in relation to the end surface 63, such that the height h of the intermediate piece 64 starting from the bases of the grooves 61, 62 is lower than the height H of the end, or bearing, surface 63.

When the detent element 80 is snapped into the latching groove 61, it extends axially therein, such that the dead stop 61*a* prevents (further) turning of the sleeve 60 about its axis in the direction 98 through the interaction with the detent element.

In the same manner, the dead stop 62*a* prevents (further) turning of the sleeve 60 about its axis in the direction 99 through the interaction with the detent element when the detent element is snapped into the latching groove 62.

The respective latching surfaces 61*b*, 62*b* are sloped such that the grooves become axially wider toward the exterior at these sides. There is also a step 64*a*, 64*b* in each groove in this example, which extends initially at a right angle from the groove in the axial direction, and subsequently transitions into the sloping latching surfaces 62*a* and 62*b*. The sloped design of the latching surfaces 61*b*, 62*b* and the placement of the steps 64*a*, 64*b* facilitates the pressing down of the conical end of the detent element 80 when the sleeve 60 is turned.

The sloped latching surfaces 61*b*, 62*b* allow the sleeve 60 to be turned beyond these surfaces when the sleeve 60 is turned in the corresponding direction and subjected to a force with which the force of the second spring element 81 can be overcome. In other words, the respective latching surface 61*b*, 62*b* pushes down the detent element 80 when it interacts with the detent element 80, thus allowing a rotation to the other respective gas regulating setting.

The example gas adjustment device 6 also has a guide segment 65 that is complementary to guide element in the gas block, which can be inserted into the guide element. This section can be inserted into the guide element such that an axial movement of the example gas adjustment device 6 toward the muzzle is prevented in a form-fitting manner.

The guide segment 65 is formed by a radial projection that borders radially on the intermediate piece 64.

Figure 17:
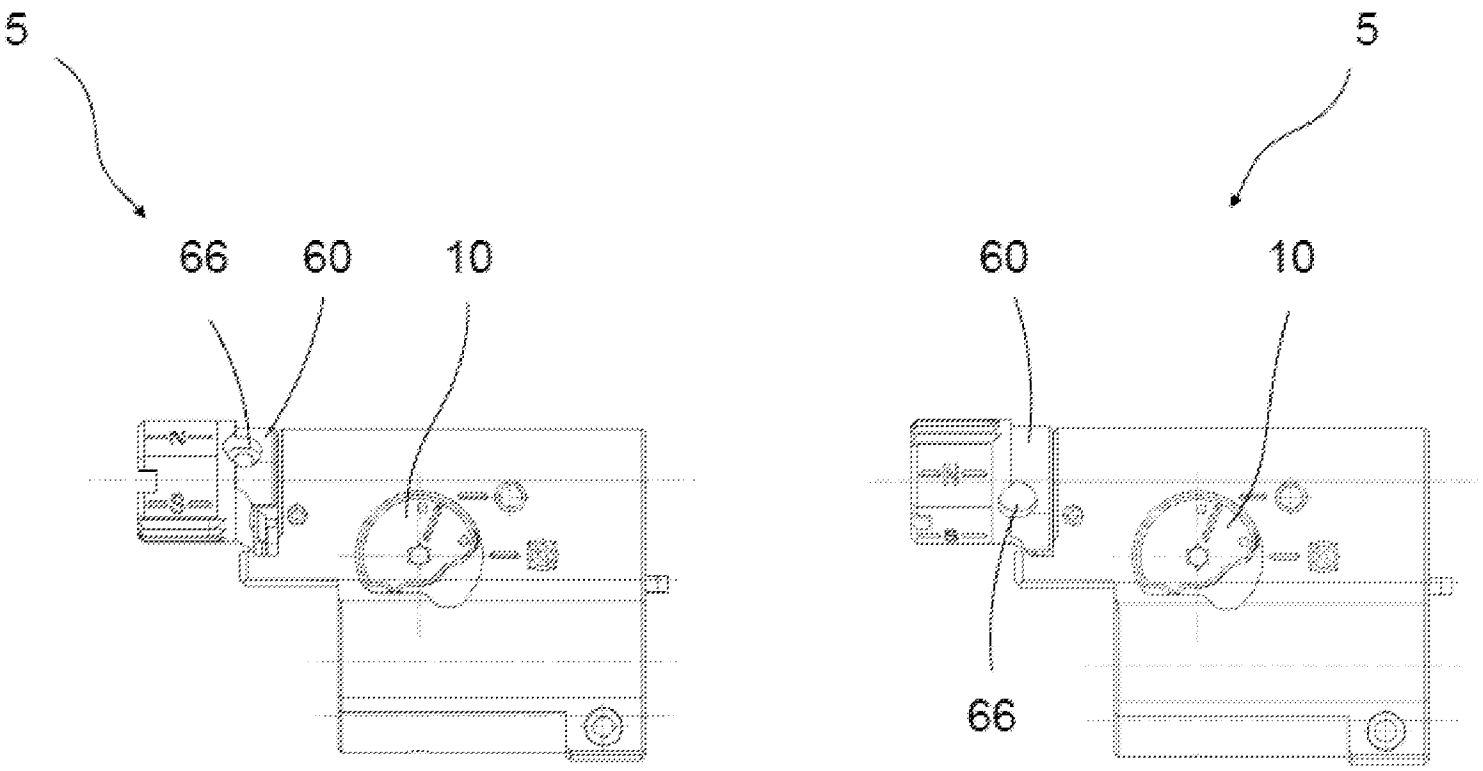
FIG. 17 shows an example side view of the gas block with the gas adjustment device in FIGS. 15 and 16 in a first and second gas regulating setting.

FIG. 17 shows the example gas block 5 with the example gas adjustment device 6 in the first gas regulating setting (in the image on the left) and in a second gas regulating setting (in the image on the right). In the first gas regulating setting of the example gas adjustment device 6, a fluid-tight connection between the two gas discharge openings 66, 67 and the two gas discharge channels 58, 59 is obtained (i.e., the example gas adjustment device 6 is open). The open setting is intended in particular for operation with a signature suppressor ("S"). In the second gas regulating setting of the example gas adjustment device 6, the two gas discharge channels 58, 59 are closed by the inner wall of the sleeve 60 (i.e., the example gas adjustment device 6 is closed). The closed setting is intended in particular for operation without a signature suppressor, the so-called normal operation ("N"). In both images, the control element 10 is in the first switching position.

Figure 18:
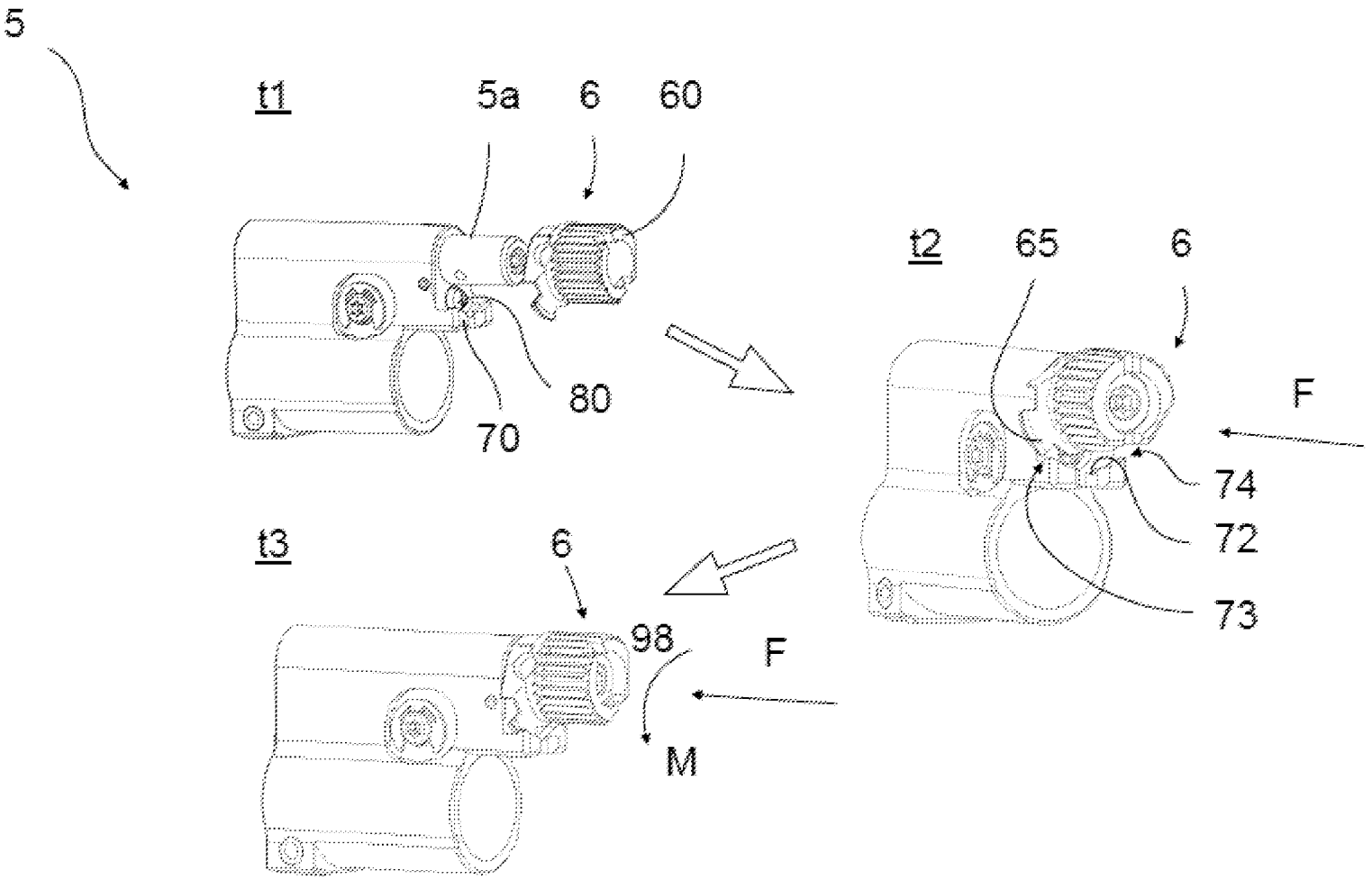
FIG. 18 shows the example steps for assembling the gas block.

FIG. 18 shows how the example gas adjustment device 6 is mounted on the example gas block 5 in three steps.

The user first places the example gas adjustment device 6 on the section 5*a* of the example gas block 5 extending toward the muzzle (t1) and slides it thereon such that the radial projection 65 extends toward the right side of the example gas block 5 and can be slide axially past the guide element 70, 72. The second detent element 80 is then pressed into the blind hole 82 counter to the force of the spring element 81 (t2). The example gas adjustment device 6 is then turned counterclockwise in the one direction 98, and the guide segment 65 is guided into the insertion section 73 in the guide groove 72. The sleeve 60 is to be then turned in the one direction 98 until the detent element snaps into the selected latching groove. In the sequence described above, the detent element 80 is first snapped into the first latching groove 61 (t3) and subsequently into the second latching groove 62.

It is also possible to insert the segment 65 into the guide groove 72 via the other insertion section 74 by turning it counter to the one rotational direction 98.

To remove the example gas adjustment device 6, the second detent element 80 must first be pressed down with an appropriate tool. The sleeve 60 can then be twisted in or counter to the one direction 98, until it exits the guide element 70, 72 in the example gas block 5. The sleeve 60 can then be pulled off.

Further designs consistent with the disclosure can be derived by a person skilled in the art from the following aspects, claims, and attached drawings.

Example aspects of the gas block without the control element shall be described below.

Aspect 1: A gas block for an automatic firearm, comprising: a gas adjustment device at the end of the gas block extending toward the muzzle, which encompasses a section of the gas block extending toward the muzzle and can be connected in a fluid-tight manner to the gas discharge nozzle for gas discharge, wherein the gas adjustment device can be releasably coupled to the gas block via an attachment device, wherein there is a detent element supported on a spring element that can be brought into contact with the gas adjustment device in the gas block, and there are at least two latching grooves in which the detent element can engage on the gas adjustment device, such that the gas adjustment device can be locked in place in at least a first gas regulating setting and at least a second gas regulating setting by turning it about its own axis.

Aspect 2: The gas block according to Aspect 1, wherein the at least two latching grooves each form a dead stop and a latching surface for the second detent element on the circumference of an end surface of the gas adjustment device, wherein the respective dead stop prevents turning of the gas adjustment device in one direction in a form-fitting manner in each case through its interaction with second detent element, and wherein the respective latching surface allows the second detent element to be pressed down through its interaction with the second detent element, such that the gas adjustment device can then be turned in the other direction.

Aspect 3: The gas block according to Aspect 1 or 2, wherein the gas block has a guide element at its end extending toward the muzzle, and the gas adjustment device has a complementary guide segment that can be inserted into the guide element in order to prevent an axial movement of the gas adjustment device toward the muzzle in a form-fitting manner, when it has been inserted therein.

Aspect 4: A gas block according to Aspect 3, wherein the guide element is formed by at least one guide groove formed on an axial projection on the end of the gas block extending toward the muzzle, which is coaxial to the section extending toward the muzzle, and the guide segment is formed by a complementary radial projection on the gas adjustment device, which can be inserted into an insertion section of the guide groove.

Aspect 5: The gas block according to any of the Aspects 1 to 4, wherein the gas adjustment device can be slide axially onto the section extending toward the muzzle to couple the gas adjustment device to the gas block, and can be rotated about its longitudinal axis such that a bearing surface on the gas adjustment device first presses against the detent element counter to the force of the second spring element, and by turning it in one of the two directions, the second detent element is able to engage in one of the two latching grooves through the force of the second spring element.

Aspect 6: The gas block according to any of the Aspects 1 to 5, wherein the second detent element can be pressed down counter to the force of the second spring element to release the gas adjustment device, and the gas adjustment device can be turned in one of two directions when the second detent element is pressed down.

Aspect 7: The gas block according to Aspect 6, wherein the axial projection on the end of the gas block extending toward the muzzle also forms a barrier, which prevents the second detent element from being pressed down by a user's fingertip, and allows the detent element to be pressed down using a tooled designed for this purpose.

The invention claimed is:

1. A gas block for a firearm, the gas block comprising:

a gas cylinder to be connected in a fluid-tight manner to a hole in a firearm barrel via a gas channel; and a control element movable between first and second positions, wherein in the first position the control element opens the gas channel by forming a fluid-tight connection, and wherein in the second position the control element closes the gas channel by interrupting the fluid-tight connection, wherein the control element includes a bore, a first sealing element, and a second sealing element, the bore arranged between the first sealing element and the second sealing element along a longitudinal axis of the control element, wherein the gas block includes a recess to accept the control element, the recess includes a first stopping surface to maintain the position of the control element in the first position and a second stopping surface to maintain the position of the control element in the second position.

2. The gas block according to claim 1, wherein the control element includes a nozzle body having the bore and an outer wall, and the nozzle body movable such that in the first position the bore connects the gas cylinder to the hole in the firearm barrel in the fluid-tight manner, and in the second position, the outer wall of the nozzle body closes the gas channel.

3. The gas block according to claim 2, wherein the control element is located in the gas block in an orientation that is transverse to a direction in which the firearm is fired.

4. The gas block according to claim 3, wherein the control element can be moved along the longitudinal axis in the gas block to switch between the first and second positions.

5. The gas block according to claim 4, wherein the gas block includes a hole through which the control element is at least partially inserted.

6. The gas block according to claim 5, further including first and second retaining elements for axially securing the control element in the gas block.

7. The gas block according to claim 6, wherein the first sealing element and the second sealing element seal the gas channel.

8. The gas block according to claim 7, wherein the control element can be locked in place in the first and second positions via a first detent element supported on a first spring element.

9. The gas block according to claim 8, wherein the control element includes a first bearing surface that can be brought into contact with the first detent element, and wherein the control element includes a first and second recesses corresponding to the first detent element and into which the first detent element can be snapped.

10. The gas block according to claim 9, wherein the first and second recesses have an angular spacing to one another that lies between 30° and 90°.

11. The gas block according to claim 10, wherein the control element includes an operating element adjustable on a left and/or right side of the gas block.

12. The gas block according to claim 11, further including a gas adjustment device at an end of the gas block extending toward a muzzle of the firearm, wherein the gas adjustment device can be connected in a fluid-tight manner to a gas discharge nozzle in the gas block, in order to discharge gas.

13. The gas block according to claim 12, further including a second detent element in the gas block supported on a second spring element that can be brought into contact with the gas adjustment device, and wherein the gas adjustment device includes first and second latching grooves in which the second detent element can engage such that the gas adjustment device can be locked in place in a first gas regulating setting and a second gas regulating setting by turning the gas adjustment device.

14. The gas block according to claim 13, wherein the first and second latching grooves each form a dead stop and a latching surface for the second detent element along a circumference of an end surface of the gas adjustment device, wherein the respective dead stops each prevent turning of the gas adjustment device in one direction in a form-fitting manner through their interaction with the second detent element, and wherein the respective latching surfaces allow the second detent element to be pressed down in their interaction with the second detent element, such that the gas adjustment device can be turned in the other direction in each case.

15. The gas block according to claim 13, wherein the gas block further includes a guide element on its end extending toward the muzzle of the firearm, and the gas adjustment device includes a complementary guide segment that can be inserted in the guide element, wherein the complementary guide segment prevents an axial movement of the gas adjustment device toward the muzzle of the firearm in a form-fitting manner, when the complementary guide segment has been inserted in the gas adjustment device.

16. The gas block according to claim 15, wherein the guide element is formed by at least one guide groove formed on an axial projection on the end of the gas block extending toward the muzzle of the firearm, wherein the axial projection is coaxial to a section extending toward the muzzle of the firearm, and the complementary guide segment is formed by a complementary radial projection on the gas adjustment device, which can be inserted into an insertion section of the guide groove.

17. The gas block according to claim 16, wherein the gas adjustment device can be slid axially onto the section extending toward the muzzle of the firearm and turned about its longitudinal axis such that a bearing surface on the gas adjustment device first pushes against the second detent element counter to a force of the second spring element, and the turning thereof in one of the two directions allows the second detent element to engage in one of the two latching grooves through the force of the second spring element.

18. The gas block according to claim 17, wherein the second detent element can be pressed in, counter to the force of the second spring element, in order to release the gas adjustment device, and the gas adjustment device can be turned in one of two directions when the second detent element is pressed down.

19. The gas block according to claim 18, wherein the axial projection at an end of the gas block extending toward the muzzle of the firearm also forms a barrier that prevents the second detent element from being pressed down and allows the second detent element to be pressed down using a tool.

20. A control element for operation with a gas block, the control element comprising:

a nozzle body having a longitudinal axis; and a bore having an axis wherein the axis of the bore is transverse to the longitudinal axis of the nozzle body and the bore is arranged between a first sealing element of the control element and a second sealing element of the control element along a longitudinal axis of the control element, wherein the control element is movable between first and second positions, wherein in the first position the control element opens a gas channel by forming a fluid-tight connection, and wherein in the second position the control element closes the gas channel by interrupting the fluid-tight connection, and wherein the gas channel is between a gas cylinder in the gas block and a hole in a barrel of an automatic firearm, wherein the control element is accepted in a recess of the gas block, and wherein the recess includes a first stopping surface to maintain the position of the control element in the first position and a second stopping surface to maintain the position of the control element in the second position.

21. A gun barrel comprising:

a gas block including a recess to accept a control element, the recess including a first stopping surface to maintain the position of the control element in a first position and a second stopping surface to maintain the position of the control element in a second position;

a gas cylinder to be connected in a fluid-tight manner to a hole in a firearm barrel via a gas channel; and a control element movable between the first and second positions, wherein in the first position the control element opens the gas channel by forming a fluid-tight connection, and wherein in the second position the control element closes the gas channel by interrupting the fluid-tight connection, wherein the control element includes a bore, a first sealing element, and a second sealing element, the bore arranged between the first sealing element and the second sealing element along a longitudinal axis of the control element.

22. An automatic firearm comprising:

a gas block including a recess to accept a control element, the recess including a first stopping surface to maintain the position of the control element in a first position and a second stopping surface to maintain the position of the control element in a second position;

a gas cylinder to be connected in a fluid-tight manner to a hole in a firearm barrel via a gas channel; and a control element movable between the first and second positions, wherein in the first position the control element opens the gas channel by forming a fluid-tight connection, and wherein in the second position the control element closes the gas channel by interrupting the fluid-tight connection, wherein the control element includes a bore, a first sealing element, and a second sealing element, the bore arranged between the first sealing element and the second sealing element along a longitudinal axis of the control element.

* * * * *